US005771947A

United States Patent [19]

Kountz et al.

[11] Patent Number: 5,771,947

[45] Date of Patent: Jun. 30, 1998

[54] COMPUTER READABLE MEDIUM HAVING A COMPUTER PROGRAM FOR DISPENSING COMPRESSED NATURAL GAS

[75] Inventors: Kenneth J. Kountz, Palatine; William E. Liss, Libertyville; Christopher F. Blazek, Palos Hills, all of Ill.

[73] Assignee: Gas Research Institute, Chicago, Ill.

[21] Appl. No.: 878,871

[22] Filed: Jun. 19, 1997

Related U.S. Application Data

[62] Division of Ser. No. 618,975, Mar. 20, 1996.

[51] Int. Cl.[6] ..... B65B 1/30; B65B 3/26

[52] U.S. Cl. ..... 141/83; 141/4; 141/18; 141/95; 137/80; 73/149; 364/55.7; 364/564

[58] Field of Search ..... 141/2–4, 18, 21, 141/37, 39, 47–49, 51, 83, 94, 95, 98, 231; 222/52, 54, 56; 364/557, 558, 564; 137/80; 73/149; 48/190, 191

*Primary Examiner*—Henry J. Recla
*Assistant Examiner*—Timothy L. Maust
*Attorney, Agent, or Firm*—Thomas, Kayden, Horstemeyer & Risley

[57] ABSTRACT

A method and apparatus for dispensing natural gas into the natural gas vehicle cylinder of a motor vehicle is disclosed. The natural gas dispensing system includes a pressure transducer and a temperature transducer for measuring the pressure and temperature, respectively, of the supply gas as it is passed toward a dispenser, a second pressure transducer for measuring the pressure within the natural gas vehicle cylinder, an ambient air temperature transducer for measuring ambient air temperatures at the dispensing site, and a mass flow meter for measuring the gas mass injected into the vehicle cylinder. Each transducer and the mass flow meter emits a data signal to a control processor which automatically dispenses compressed gas to the vehicle cylinder, as well as maximizing the amount of gas mass injected into the cylinder. The control processor maximizes the mass of compressed gas injected into the vehicle cylinder by injecting a first mass of compressed gas into the cylinder and calculating a first volume estimate in response thereto, estimating a second mass of compressed gas required to fill the cylinder to a first predetermined fill state, and then estimating a third mass of compressed gas required to fill a reference gas cylinder to the first predetermined fill state in response thereto. Thereafter, the second mass of compressed gas is injected into the cylinder, the gas mass being injected into the cylinder from the initial state being measured, as well as the pressure of the compressed gas within the container resulting from the injection of the second gas mass being measured, whereupon the control processor estimates a second volume of the gas container in response thereto. Thereafter, the control process may be used to either perform a final fill step to complete the gas mass injection into the cylinder, or may perform a second intermediate fill step prior to the final fill step for greater accuracy in determining tank volume during the fill process.

6 Claims, 14 Drawing Sheets

COMPUTER READABLE MEDIUM HAVING A COMPUTER PROGRAM FOR DISPENSING COMPRESSED NATURAL GAS

This is a divisional of copending application Ser. No. 08/618,975 filed on Mar. 20, 1996.

FIELD OF THE INVENTION

This invention relates in general to the dispensing of compressed natural gas. More particularly, this invention relates to a method and apparatus for dispensing compressed natural gas from a dispensing station, and of accurately predicting the final gas pressure and temperature within a compressed natural gas storage cylinder for maximizing the mass of compressed natural gas injected into the gas storage cylinder without exceeding the gas density rating and/or maximum design pressure thereof.

BACKGROUND OF THE INVENTION

As efforts are made to reduce motor vehicle exhaust emissions and to reduce air pollution, automobile manufacturers have turned toward the development of alternate fuel sources for motor vehicles. One of these fuel sources is compressed natural gas ("CNG"), an abundant, relatively inexpensive, and clean burning fuel. However, and unlike conventional hydrocarbon motor fuels, for example gasoline, compressed natural gas cannot be poured or dispensed as simply as hydrocarbon fuels may be, rather compressed natural gas is typically injected under pressure into a compressed natural gas vehicle cylinder.

As with gasoline powered vehicles, the on board storage capacity of the compressed natural gas vehicle cylinder, also referred to as the "cylinder", defines the maximum driving range of the motor vehicle before refueling is required. The underfilling of compressed natural gas vehicle cylinders, especially during fast fill charging operations, i.e., those taking less than five minutes, can occur at fueling stations having dispensers which are incorrectly or inaccurately compensated for initial cylinder and station supply gas pressures, as well as the supply gas temperature(s) and the ambient temperature at the dispensing station. At higher ambient temperature conditions, for example, those which exceed the "standard temperature" of 70 degrees fahrenheit, and under direct station compressor outlet charging of the cylinder, the underfilling of the cylinder can reach 20% or more of its rated gas mass storage capacity. This underfilling is a serious obstacle the natural gas industry must overcome in order to make compressed natural gas powered motor vehicles more acceptable by maximizing the driving range between cylinder fills. Moreover, this underfilling must be resolved without resorting to unnecessarily high fueling station gas storage pressures, or by extensively overpressurizing the cylinder during the fueling operation which may result in dangerous cylinder load conditions, and/or result in the venting of overpressurized compressed natural gas into the ambient air surrounding a motor vehicle, with the accompanying hazards of explosion or fire.

A primary cause of undercharging cylinders during fast fill operations is a result of fueling station dispensers which either ignore, or inaccurately estimate, the elevated compressed natural gas cylinder gas temperatures which occur in the charging process due to the compression, mixing, and other complex and transient thermodynamic processes, i.e., the conversion of gas enthalpy to temperature changes, resulting from the injection of compressed natural gas into a cylinder of generally unknown volume. This is shown graphically in FIG. 1, where the vehicle cylinder temperature is shown as function of the change in injected gas mass for two cylinder volumes of 500 s.c.f. and 2,000 s.c.f., respectively, and at two initial cylinder gas pressures. As shown, if a cylinder is relatively full of gas when gas mass injection is started, shown by the 1,500 psi pressure lines, cylinder temperature rises in a generally linear manner which can be predicted to some degree. However, if initial cylinder pressure and thus volume is low, cylinder temperatures change in a more unpredictable fashion, making full cylinder fills difficult to determine. Another aspect of cylinder underfill problems is shown in FIG. 2, wherein three pairs of representative test data are shown, each pair starting at the same pressure and temperature in the cylinder. In FIG. 2 the temperatures shown in parentheses represents the average supply gas temperature over the fill process. Thus the importance of being able to accurately account for the supply conditions prior to and during the charging of the cylinder is shown by the differing endpoint temperatures and pressures resulting for each test pair due to only a difference in supply gas temperatures. This again demonstrates the dynamic nature of the compressed natural gas fill process. Yet another reason for the undercharging of cylinders is that the industry has not adopted a standard size cylinder for use in motor vehicles, and in some instances standard size cylinders cannot be used based upon the size of the motor vehicle as well as its intended load carrying capacity. This results in inaccuracies in the charging/fill process from not being able to accurately determine the volume of the cylinder, and thus the mass of compressed gas which can be injected into the cylinder, to maximize the gas mass fill in the charging process.

As is known, during the charging, or injection, of compressed natural gas into a cylinder, the expansion of the gas in flowing from a station ground storage reservoir, or directly from a station compressor outlet, for example, tends generally to reduce the temperature of the compressed natural gas entering the cylinder due to the Joule-Thomson effect which occurs during this essentially constant enthalpy process, see FIG. 1. However, as the compressed natural gas enters the cylinder, the enthalpy of the gas is converted into internal energy, which equates to increases in internal cylinder gas temperature. The temperature range which results from this conversion of the compressed gas enthalpy into internal energy is a function not only of the size of the cylinder, however, but also of the pressure and temperature of the compressed gas being injected into the cylinder, as well as the pressure of the gas already in the cylinder prior to the injection of additional compressed natural gas, and the ambient temperature conditions at the dispensing station. Thus, as the enthalpy of the compressed natural gas entering the cylinder is converted into internal energy within the cylinder, the gas undergoes complex and dynamic compression and mixing processes which typically overcome the cooling effect of the compressed natural gas being injected into the cylinder, resulting in increased cylinder temperatures which do not necessarily equate to an accurate and complete injection of a full gas mass into the cylinder.

Most charging processes in the art are typically terminated when the fueling station dispenser measures, or estimates, the point of which the natural gas storage vehicle cylinder reaches a certain pressure level. Depending on the dispenser control system used, this level of cylinder cut-off pressure may have some dependence on ambient or station gas conditions, but typically fails to take into account the impact of the enthalpy to internal energy conversion which occurs during the fill process as it impacts cylinder pressures and temperatures. This will oftentimes result in an inaccurate or incomplete cylinder fill, which is especially problematic during fast fill charging operations. Although this problem may be lessened to some degree during a more protracted fill process, the expectations of consumers are that they will be able to fuel their motor vehicles quickly, efficiently, and safely in a fill process which will typically takes less than five minutes.

An example of a dispenser control system which employs a pre-calculated cutoff pressure scheme is the method and apparatus for dispensing compressed natural gas disclosed in U.S. Pat. No. 5,259,424 to Miller et al., issued Nov. 9, 1993. The control system of Miller et al calculates a vehicle tank cut-off pressure based on the ambient air temperature at the dispenser and the pressure rating of the vehicle cylinder pre-programmed into the control system. Miller et al. then calculate the volume of the vehicle tank and an additional mass of compressed natural gas required to increase the tank pressure to the cut-off pressure, whereupon the dispenser automatically turns off the compressed natural gas flow into the vehicle cylinder once the additional mass necessary to obtain the cut-off pressure has been injected into the cylinder. Although Miller at al. teach a method and apparatus which predetermines an amount of compressed natural gas, i.e., a gas mass, for injection into the gas cylinder, the mass of gas to be injected is based upon an estimated cut-off pressure within the vehicle cylinder, and is thus not a true mass based system which seeks to maximize the amount of gas mass injected into the cylinder, so long as the pressure limit of the cylinder is not exceeded.

Thus, and for the reasons discussed above, the temperatures that compressed natural gas vehicle cylinders reach at the end of dynamic fill or charging processes have been difficult to accurately predict in the known dispenser fill and control methodology. Thus, what is needed, but seemingly not available in the art, is a method and apparatus for dispensing compressed natural gas which compensates for the increase in cylinder gas temperatures during the charging process, and which also take into account initial cylinder pressure and temperature conditions, as well as supply gas pressure and temperature conditions, in order to maximize the gas mass injected into a compressed natural gas vehicle cylinder for maximizing the driving range of a motor vehicle before the next fill process need be undertaken.

SUMMARY OF THE INVENTION

Briefly described, the present invention provides an improved method and apparatus for dispensing compressed natural gas and maximizing gas mass injection into a compressed natural gas vehicle storage cylinder which overcome some of the design deficiencies of other compressed natural gas dispensing methods and apparatuses known in the art by providing a unique method and apparatus for dispensing compressed natural gas which takes into account the conversion of compressed gas enthalpy into internal energy and the resulting increases in tank pressures and temperatures which result therefrom. This new method and apparatus for dispensing compressed natural gas thus results in the safe, efficient, and complete gas mass injection of compressed gas into storage cylinders. This is accomplished in part through a multi-step fill process which involves cylinder volume identification at two more steps during the charging process, and a closed loop control over the dispenser fill valve based on the measured gas mass injected into the cylinder. The method and apparatus of this invention correlates the measured cylinder pressure responses to the mass of compressed gas injected into the cylinder in conjunction with predicted pressure responses used as a means of control over the steps of the fill process.

The fill process of our invention is well-suited for use at a compressed gas dispensing station having a supply of compressed gas, be it natural gas, propane, butane, or any other similar fuel gas. The dispensing station has a pressure tight dispensing hose connected to a dispenser fill valve through which the compressed gas is injected into the gas cylinder, plus conventional means, for example transducers, for measuring the pressure and temperature of the compressed gas injected into the cylinder, the cylinder having an initial pressurized state and a cylinder limit pressure. In our fill process the dispensing hose is connected to the vehicle cylinder and a first mass of compressed gas is injected into the cylinder so that a first estimate of cylinder volume is obtained in response thereto. Thereafter, we estimate the amount of a second mass of compressed gas needed to fill the vehicle cylinder to a first predetermined fill state, as well as estimating a third mass of compressed gas needed to fill a reference cylinder, used as a model, to the first predetermined fill state in response thereto. The second mass of compressed gas is then injected into the vehicle cylinder. The total gas mass injected into the vehicle cylinder is measured from the initial cylinder fill/mass state, and the pressure of the compressed gas within the cylinder resulting from the injection of this second mass of compressed gas therein is also measured. A second estimate of the vehicle cylinder volume is then made for greater accuracy in completing the fill process.

Thereafter, our improved process for filling compressed gas cylinders can be completed by computing a fourth mass of compressed gas that will result in a compressed gas pressure within the reference cylinder, from its initial cylinder state, which equals the measured pressure of the compressed gas within the vehicle cylinder after the second gas mass has been injected therein, computing a fifth mass of compressed gas to be injected into the vehicle cylinder for attaining a final fill state in response thereto, and then injecting the fifth mass of compressed gas into the vehicle cylinder to complete the fill process.

In the alternative, however, when a more accurate determination of the volume, and thus gas mass to be injected into a cylinder is desired, our automatic fill process, and the apparatus which practices this process, estimates a fourth mass of compressed gas required to fill the vehicle cylinder to a second intermediate fill state, estimates a fifth mass of compressed gas required to fill the reference cylinder to the second intermediate fill state, injects the fourth mass of compressed gas into the vehicle cylinder, and then calculates a third volume estimate of the cylinder in response thereto. Thereafter, the fill process is completed by computing a sixth mass of compressed gas that will result in a gas pressure within the reference cylinder, from its initial state, which equals the measured pressure of the compressed gas within the vehicle cylinder after the fourth mass has been injected, then computing a seventh mass of compressed gas to be injected into the vehicle cylinder for attaining a final fill state in response thereto, followed by injecting the seventh (final) mass of compressed gas into the vehicle cylinder.

Our compressed gas dispensing system which practices the above described process includes a control processor; a pressure transducer and a temperature transducer for measuring the pressure and temperature of the supply gas in a supply gas plenum, each of which signals temperature and pressure data signals thereof to the control processor, respectively; a second pressure transducer measuring the pressure of the compressed gas within the gas cylinder; a second air temperature transducer for measuring the ambient air temperature at the dispenser; a compressed natural gas dispenser; a mass flow meter in the dispenser in sealed fluid communication with the supply plenum, the mass flow meter signaling the measured mass of compressed gas injected into the gas container to the control processor; a solenoid fill valve actuated by signals received from the control processor, and providing a feed-back signal to the control processor for the operation of the solenoid fill valve; and a computer program stored within the control processor for controlling the dispensing of compressed gas from the dispenser.

The computer program held within the control processor is stored in or on a computer readable medium, and includes mechanisms for performing the method described in greater detail, above.

Thus, it is an object of invention to provide an improved method and apparatus of dispensing compressed natural gas which maximizes the mass of compressed gas injected into a compressed natural gas cylinder during a fast fill charging operation.

An additional object of our invention is to provide an improved method and apparatus of dispensing compressed natural gas which provides a mass based fill system that fills compressed natural gas cylinders to their rated gas mass capacity.

Yet another object of the invention is to provide an improved method and apparatus for dispensing compressed natural gas which compensates for increases in gas and cylinder temperatures which occur during a fast fill charging process.

Still another object of the invention is to provide an improved method and apparatus for dispensing compressed natural gas which provides an accurate means of determining the storage volume of a compressed natural gas storage cylinder or container.

It is also an object of the invention is to provide an improved method and apparatus for dispensing compressed natural gas which accurately predicts the gas pressure and temperature conditions within a compressed natural gas cylinder after the injection of a known gas mass.

An additional object of the invention is to provide an improved method and apparatus for dispensing compressed natural gas which determines the required quantity of gas mass for injection into a compressed natural gas cylinder that will not exceed either the gas mass density or maximum gas pressure limits of the gas storage cylinder.

Still another object of our invention is to provide an improved method and apparatus of dispensing compressed natural gas which completely and/or safely fills a compressed natural gas cylinder, regardless of fill conditions, and regardless of cylinder service ratings or service pressures, to its rated gas mass capacity.

It is also an object of the invention to provide an improved method and apparatus of dispensing compressed natural gas and of filling compressed natural gas cylinders which is simple in design and operation, is inexpensive to construct and operate, and is durable and rugged in structure.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 4:
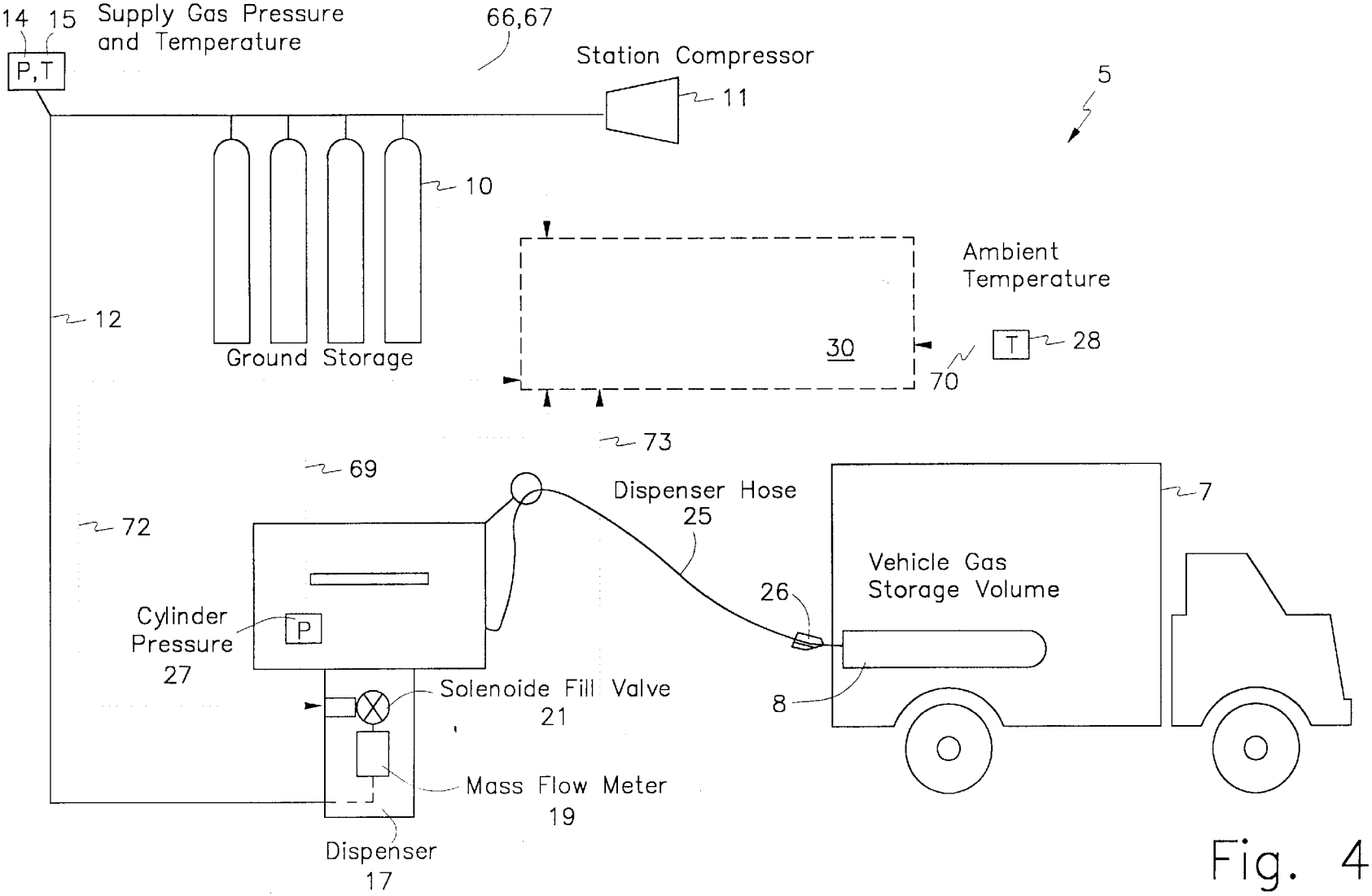
FIG. 4 is a schematic illustration of a preferred embodiment of the dispensing system of this invention.

Referring now in detail of the drawings, in which like reference numerals represent like parts through the several views, numeral 5 of FIG. 4 illustrates a preferred embodiment of our compressed natural gas dispensing system. Although natural gas dispensing station 5 is shown for use with natural gas, it is understood by those skilled in the art that natural gas dispensing station 5, as well as the method of automatically filling gas containers, can be used with any compressible fluid medium having a gaseous end-state.

Natural gas dispensing station 5 is shown here supplying compressed natural gas to a motor vehicle 7 having a natural gas vehicle cylinder 8 supported thereon. The apparatus illustrated in FIGS. 4 and 5, as well as the process illustrated in FIGS. 6A through 6I, is particularly well-suited for use in applications where the volume of gas cylinder 8 is unknown and gas cylinder 8 is to be injected with compressed natural gas in a fast fill charging operation. It is understood by those skilled in the art that a fast fill charging operation is one which generally takes five minutes or less in order to fully inject the allowable maximum gas mass within a gas cylinder before driving away from the dispensing station.

Referring to FIG. 4, natural gas dispensing station 5 is provided with a supply of compressed gas 10, shown as being in an above-ground storage tank array 10. The natural gas is compressed by a station compressor 11 through an otherwise conventional supply plenum 12, supply plenum 12 being provided with a pressure transducer 14 and a temperature transducer 15 for measuring the pressure and temperature, respectively, of the compressed natural gas being propelled through supply plenum 12 toward dispenser 17. Supply plenum 12 is a conventional high pressure gas plenum constructed and arranged for use with high pressure fluids and/or gases, the supply plenum being fluid-tight and pressure-tight.

Dispenser 17 is provided with a mass flow meter 19 which measures the mass of the compressed gas dispensed into natural gas vehicle cylinder 8. Mass flow meter 19 is in sealed fluid communication with supply plenum 12. After passing through the mass flow meter, the compressed gas then passes through solenoid fill valve 21 into a pressure-tight dispensing hose 25 having a dispenser fill connector 26 in sealed fluid communication therewith. Connector 26 is sized and shaped to be received within a pressure-tight fill neck (not illustrated) formed as a part of vehicle 7 for channeling the compressed natural gas into cylinder 8. Dispenser 17 is also provided with a pressure transducer 27 in sealed fluid communication with the compressed gas line passing from solenoid fill valve 21 toward dispensing hose 25. So positioned, pressure transducer 27 provides an accurate measure of the pressure within cylinder 8 once connector 26 is received within the appropriate receptacle (not illustrated) in motor vehicle 7, and opened so that the pressure equalizes within cylinder 8, dispenser hose 25, and in dispenser 17 back to solenoid fill valve 21. The dispenser is also provided with a separate ambient temperature transducer or sensor 28, which measures the ambient air temperature at the dispensing station.

Figure 5:
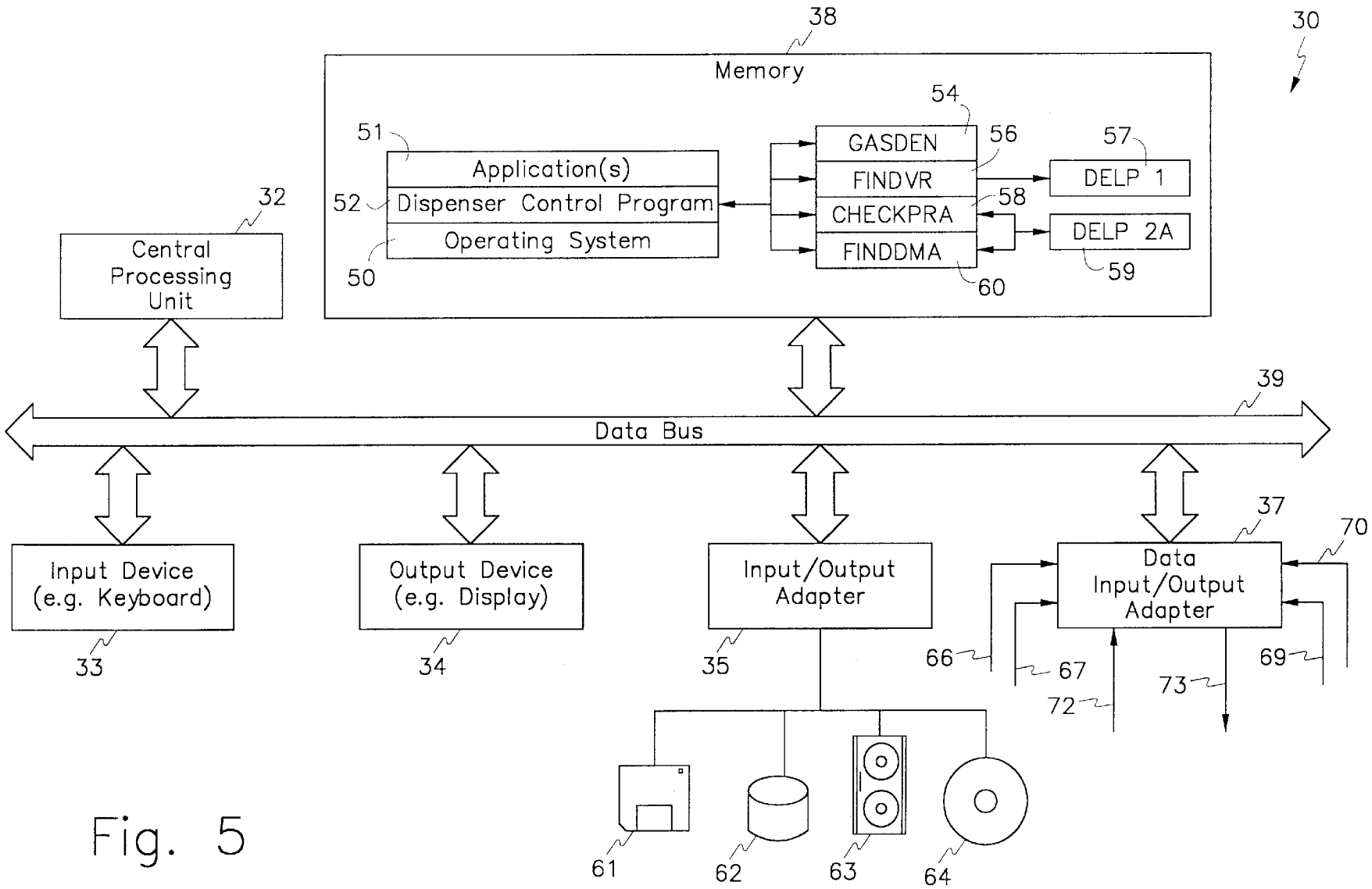
FIG. 5 is a schematic illustration of the control processor illustrated in FIG. 4.

As shown schematically in FIG. 4, pressure transducer 14, temperature transducer 15, mass flow meter 19, solenoid fill valve 21, pressure transducer 27, and ambient temperature transducer 28 each emits a separate data signal which is passed on to control processor 30, illustrated generally in FIG. 4, and more specifically in FIG. 5. Control processor 30 also emits a separate control signal back to solenoid fill valve 21 for actuating the solenoid fill valve so that compressed gas may be supplied from gas supply 10 into cylinder 8.

Control processor 30 is schematically shown in greater detail in FIG. 5. Referring now to FIG. 5, control processor 30, a computer, will read and execute computer programs stored on any suitable computer-readable medium for use in automatically dispensing natural gas into cylinder 8 and for maximizing the injection of gas mass into cylinder 8. Control processor 30 is provided with a central processing unit 32; an input device 33, for example, a keyboard, mouse, or other data inputting device; an output device 34, for example a visual display; an input/output adapter 35 for uploading and downloading data and programming information from any suitable computer-readable medium; and a data input/output adapter 37 for receiving signals emitted from the remote sensors and for directing control signals from control processor 30 toward remote locations. Control processor 30 is also equipped with a memory, i.e., a computer-readable medium 38. Memory 38 will store the operating system 50 for the control processor, any additional applications 51 used by the control processor, as well as dispenser control program 52, illustrated more specifically in FIGS. 6A through 6I. Although not shown in specific detail in FIG. 5, it is understood by those skilled in the art that memory 38 can comprise a random access memory (not illustrated) and a read only memory (not illustrated) formed as a part thereof. Each of the above described components of control processor 30 communicate with one another through data bus 39 in otherwise conventional fashion.

Dispenser control program 52 utilizes four subroutines in its execution. The four subroutines which form a part of dispenser control program 52 are shown in FIG. 5, as well as in FIGS. 6A–6I as subroutine GASDEN 54, used for determining gas density; subroutine FINDVR 56, which determines the volume of cylinder 8; subroutine FINDVR calling subsubroutine DELP1 57 which calculates the change in pressure within cylinder 8 due to a compressed gas mass injection therein. Dispenser control program 52 also includes subroutine CHECKPRA which determines whether a predicted cylinder pressure, at the end of the compressed gas mass injection cycle, will exceed the allowable pressure limit for the cylinder. Subroutine CHECKPRA calls subsubroutine DELP2A 59, sub-subroutine DELP2A computing the pressure change within a separate reference cylinder, i.e., a model cylinder, for a given mass injection. The last subroutine included in dispenser control program 52 is FINDDMA 60, which finds the change in the injected compressed gas mass for the reference cylinder so that the final pressure in the reference cylinder equals the measured pressure within cylinder 8 during the fill steps which form a part of dispenser control program 52. Subroutine FINDDMA also calls sub-subroutine DELP2A for the reasons discussed above. The programming instructions for each subroutine, and the sub-subroutines, are listed in the Appendix.

Still referring to control processor 30 as shown in FIG. 5, input/output adapter 35 is equipped to receive data as well as computer programming instructions from any one, or combination of, portable storage containers including a magnetic floppy disk 61, having a separately provided floppy disk drive (not illustrated), magnetic hard disk drive 62, magnetic digital tape 63, having a separate digital tape drive (not illustrated), and/or CD-ROM 64, CD-ROM 64 having a separately provided CD-ROM reader (not illustrated).

Data input/output adapter 37 will include any necessary analog to digital, and digital to analog converters needed to process the data signals received from the pressure and temperature transducers, as well as the mass flow meter and solenoid fill valve of gas dispensing system 5. Thus, data input/output adapter 37 receives a data signal 66 from first pressure transducer 14, a data signal 67 from first temperature transducer 15, a second pressure data signal 69 from second pressure transducer 23, a second temperature data signal from ambient air transducer 28, a separate data signal 72 from mass flow meter 19, as well as a data signal 73 from solenoid fill valve 21. However, and as shown in FIG. 5, data input/output adapter 37 also emits a control signal 73 from central processing unit 32 back to solenoid fill valve 21. This is also shown schematically in FIG. 4.

The method employed by dispenser control program 52 for automatically dispensing compressed natural gas into cylinder 8, and for injecting the maximum amount of gas mass into cylinder 8, is illustrated in FIGS. 6A through 6I. It is understood by those knowledgeable in the art that each of the blocks within FIGS. 6A through 6I is not only a step performed by dispenser control program 52, but also represents blocks of executable programming code which form a part of dispenser control program 52, as well as subroutines GASDEN, FINDVR, CHECKPRA, FINDDMA, and subsubroutines DELP1, and DELP2A. The method illustrated in FIGS. 6A through 6I, as well as the blocks of executable code which comprise this method, can be input into control processor 30 through any one of the portable storage computer readable medium devices shown as a part of input/output adapter 35, or can be stored within memory 38 so that it may be called by central processor 32 for execution.

Figure 6A:
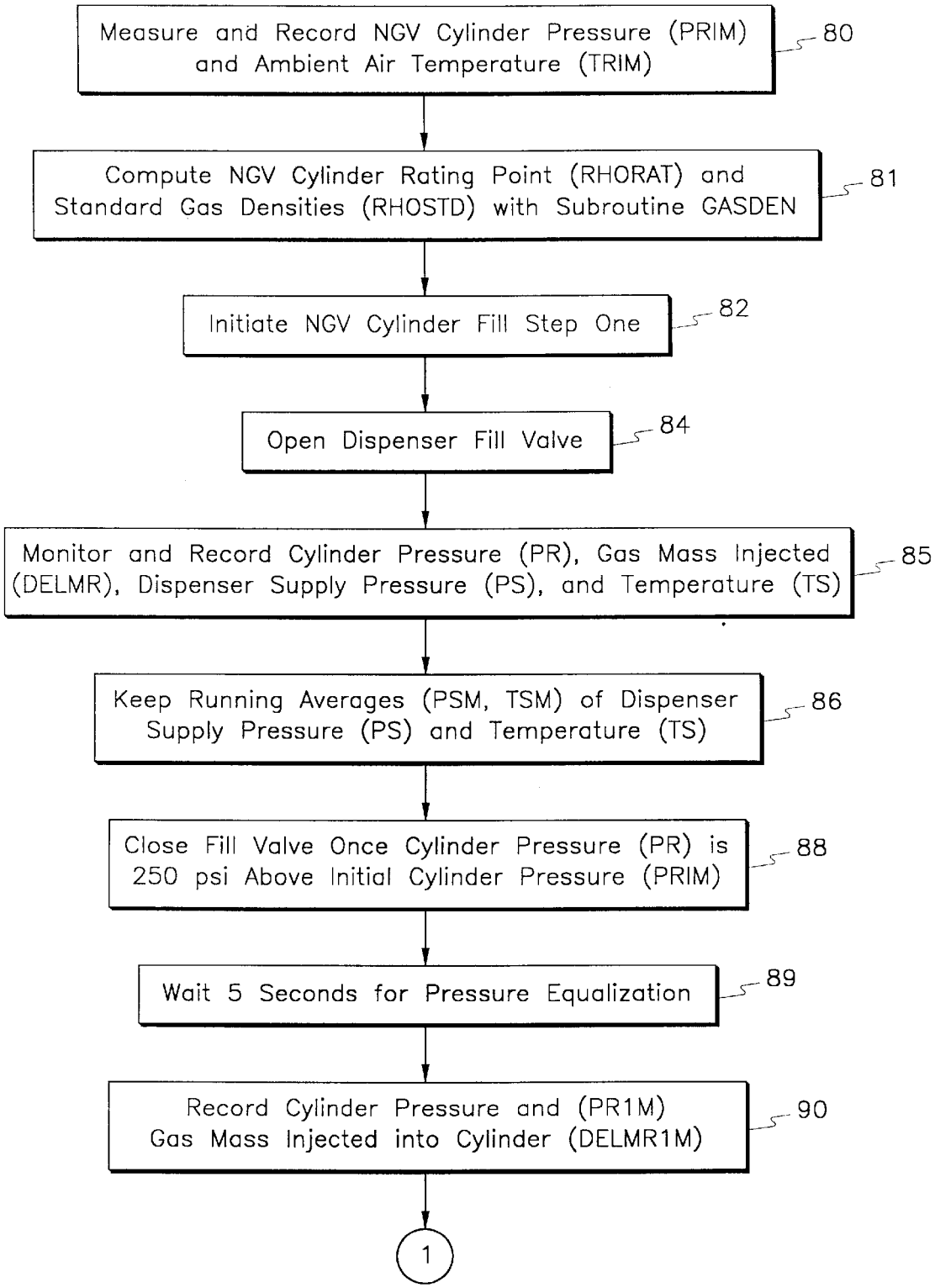
FIGS. 6A–6I are sequential flow charts illustrating the preferred embodiments of the fill process, and the control logic, implemented by dispensing system of FIG. 4.

Turning now to FIG. 6A, prior to the operation of gas dispensing station system 5, the cylinder rating pressure (PRAT) and limit pressure (PRLIM) will be known, which is accomplished as follows. Current NGV gas cylinders come in two industry standard sizes, i.e., pressure ratings, of 3000 psi and 3600 psi. Accordingly, dispenser 17 (FIG. 4) is provided with a fluid-tight dispensing hose 25, having a specifically sized connector 26 thereon for each pressure rated NGV cylinder. Confusion in determining which connector goes with which type of NGV cylinder 8 is avoided in that a different sized connector 26 is used for each of the two different NGV cylinders much as an unleaded gasoline nozzle is smaller than a leaded gasoline nozzle. Accordingly, (PRAT) will be specified internally within control processor 30, i.e., programmed in as a part of dispenser control program 52, for each separate dispensing hose/cylinder rating combination. Under the currently accepted standards, American National Standards/American Gas Association standard NGV2-1992, governing NGV cylinders, (PRLIM) is allowed to be twenty-five (25) per-cent greater than (PRAT), and thus (PRLIM) will also be specified internally for each dispensing hose/cylinder rating combination. The NGV customer and/or dispensing system operator does not therefore need to manually input this data before the start of charging operations, thus avoiding any chance of mistake.

Thus, and as shown in block 80, the initial pressure (PRIM) of cylinder 8 is measured and recorded, as well as the ambient air temperature (TRIM) at dispenser 17. Once completed, the program proceeds to block 81 in which dispenser control program 52 computes the cylinder rating point gas density (RHORAT) of cylinder 8, and determines the standard gas density (RHOSTD) within cylinder 8 using subroutine GASDEN. Subroutine GASDEN, as well as subroutines FINDVR, CHECKPRA, FINDDMA, and sub-subroutines DELP1 and DELP2A, are set out in the appendix attached hereto, and thus specific reference is not made in greater detail herein to the operations performed by each subroutine, and/or sub-subroutine respectively.

Figure 1:
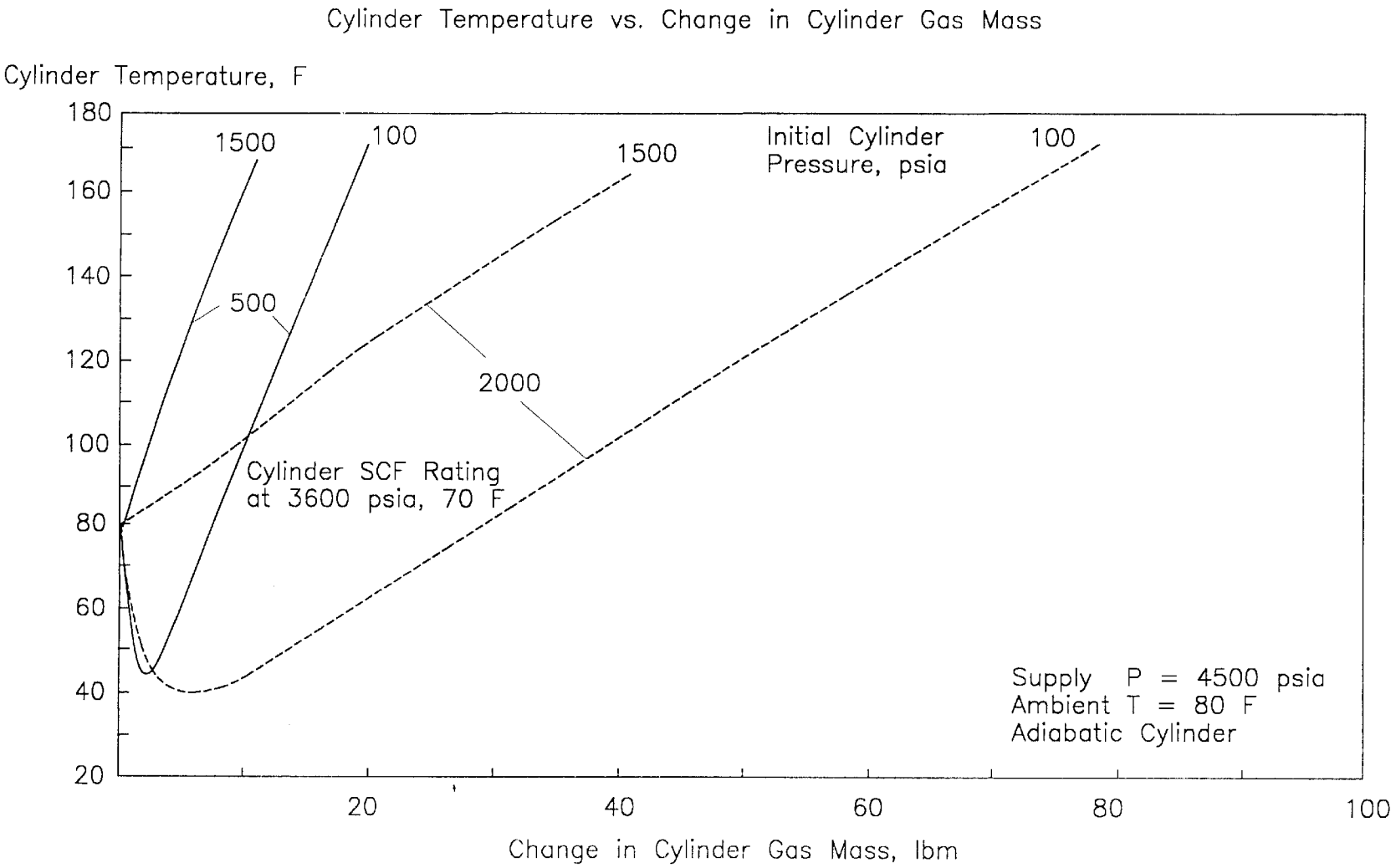
FIG. 1 is a graph illustrating how gas cylinder internal temperatures change as a function of the change in injected gas mass within the cylinder.
Figure 2:
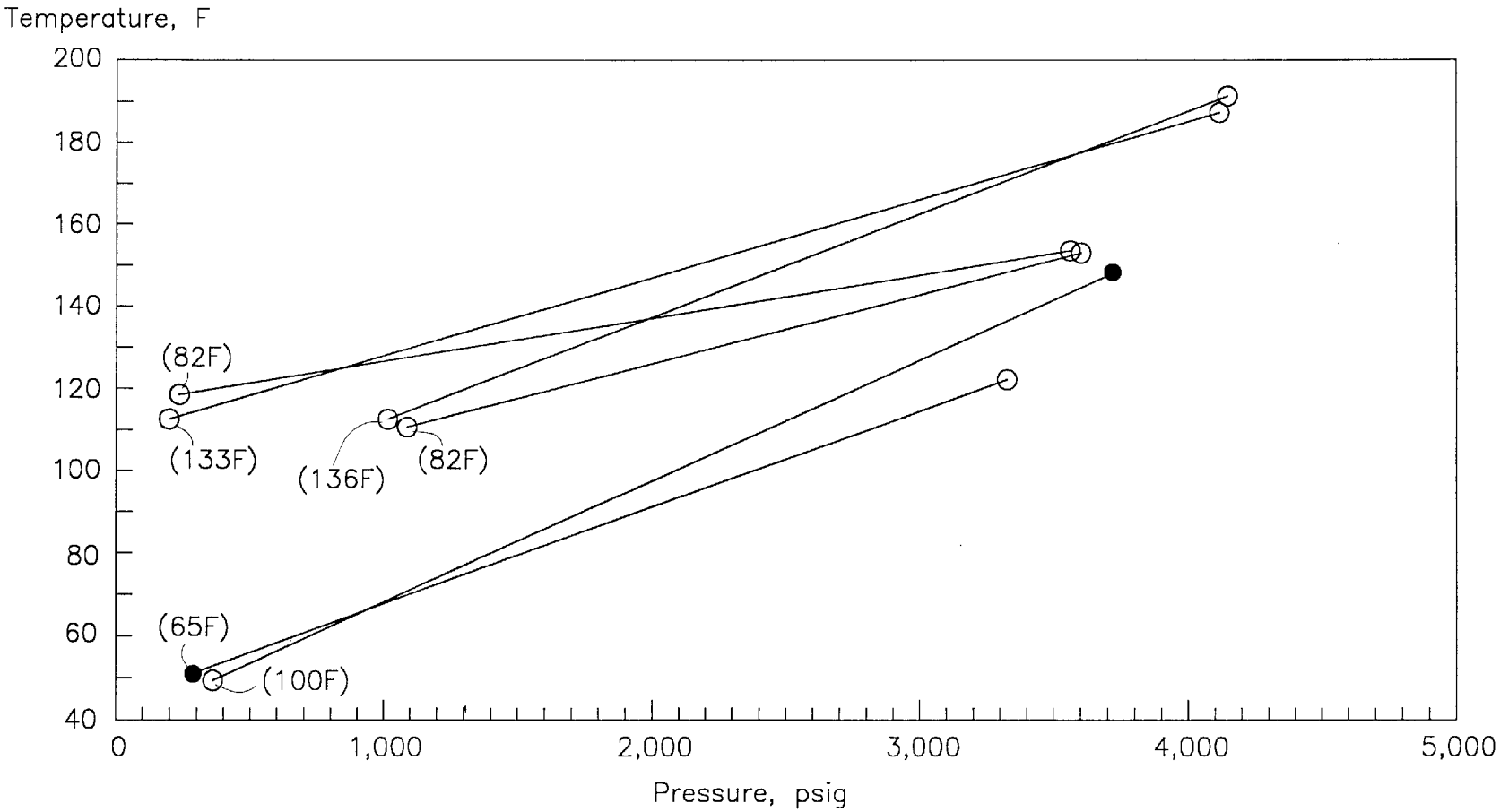
FIG. 2 is a graph showing measured end state cylinder gas conditions for a full fill with respect to varying initial cylinder pressure and temperature conditions, and supply gas temperatures.

After the execution of the steps illustrated in block 81, the program proceeds to block, or step, 82, the first cylinder fill step for cylinder 8. Cylinder fill step 1 includes opening solenoid fill valve 21 as shown in block 84, monitoring and recording the pressure (PR) and the gas mass injected (DELMR) into cylinder 8, as well as monitoring and recording the supply pressure (PS) and temperature (TS) of gas supply 10 as a first mass of compressed gas is injected into cylinder 8. The program then executes block 86, where it maintains a running average of the dispenser supply pressure (PSM) and temperature supply pressure (TSM), respectively. By maintaining these running averages, dispenser control program 52 is thus able to determine the enthalpy of the compressed gas being passed into cylinder 8 which is converted into a gas temperature change in the cylinder resulting from the injection process, this process being best illustrated in FIGS. 1 and 2, which, as described above, illustrate the difficulties inherent in determining the amount of the compressed gas mass to be injected into a cylinder in order to maximize mass fill without being misled or "tricked" into believing there is a full fill based on pressure changes within the cylinder, which is at the heart of this process and is not otherwise taken into account by any other prior art method nor apparatus of which we are aware.

Fill step 1 then proceeds to block 88, in which solenoid fill valve 21 is closed once the cylinder pressure (PR) is 250 psi above the initial cylinder pressure (PRIM). Thereafter, dispensing system 5 waits five seconds for pressure equalization, as illustrated in block 89. Step 90 is then executed, in which cylinder pressure (PR1M) is recorded, as well as the first gas mass (DELMR1M) injected into cylinder 8. Fill step 1 is thus completed.

Figure 3:
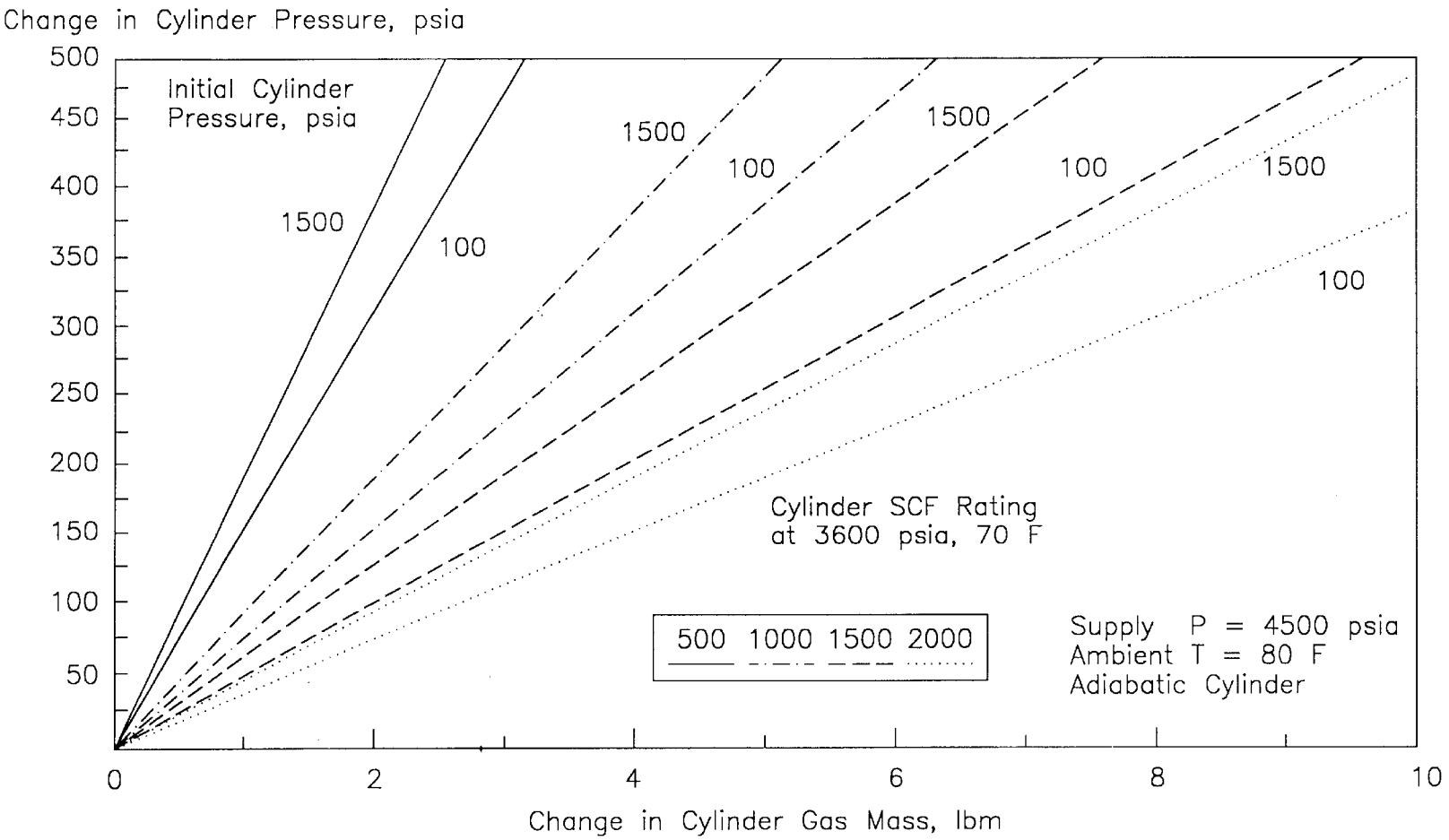
FIG. 3 is a graph showing the relationship between the change in cylinder pressure as a function of the change in injected cylinder gas mass for two initial cylinder pressure values of 100 and 1,500 psi, and for four cylinder volumes of 500, 1000, 1500 and 2000 s.c.f.
Figure 6B:
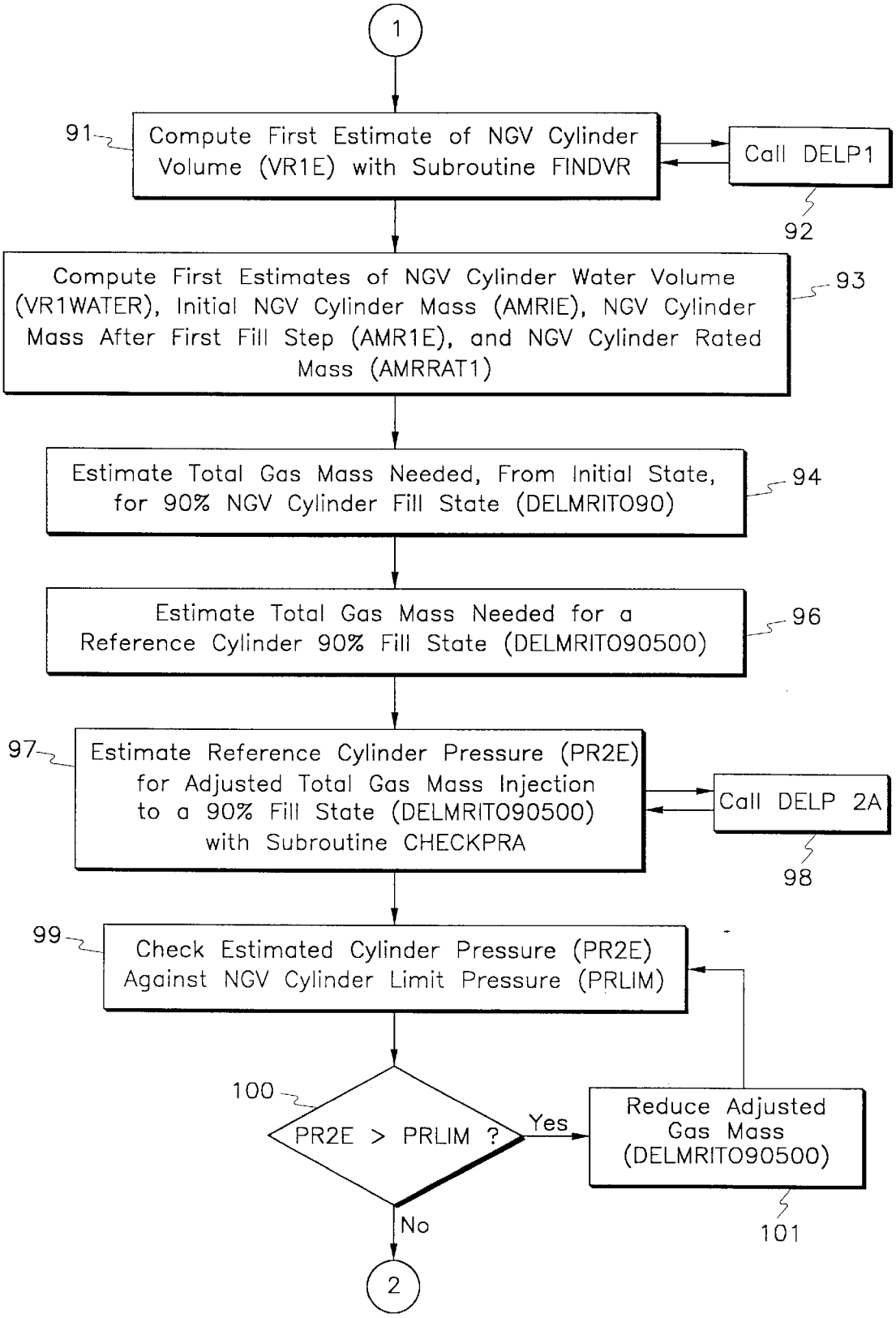

Once fill step 1 is completed, control program 52 then computes a first estimate of the volume (VR1E) of cylinder 8 using subroutine FINDVR, subroutine FINDVR, as indicated at block 91 calling subroutine DELP1 as shown in block 92 of FIG. 6B. The logic employed in sub-subroutine DELP1 is shown graphically in FIG. 3, which shows the relationship of the change in cylinder pressure as a function of the change in injected cylinder gas mass. Curves are shown for two initial cylinder pressure values, 100 psi. and 1,500 psi., for a family of four cylinder volumes, 500, 1,000, 1,500, and 2,000 s.c.f. A single gas supply pressure of 4,500 psi., and a single temperature of 80 degrees Fahrenheit is used for all pressures and volumes. DELP1 computes the change in cylinder pressure resulting from a specific gas mass injection curve fit via a regression formulation/analysis. DELP1 is repetitively called by FINDVR to iteratively solve the first volume estimate of cylinder 8.

As block 93 shows, computing the first estimate of the cylinder volume includes computing the first estimate of the cylinder water volume (VR1WATER), initial cylinder mass (AMRIE), cylinder mass after the first fill step (AMR1E), and the cylinder rated mass (AMRRAT1). The program then proceeds to block 94, whereupon an estimate is computed of the second gas mass needed, (DELMRITO90), from the initial state, for a 90% cylinder fill state. Once this is done, the program proceeds to block 96, in which it computes an estimate of the third gas mass needed (DELMRIT09500) to fill a separately provided reference cylinder (not illustrated) to a 90% fill state. That we are aware of, the use of a reference cylinder here as a model is another unique component of our method and apparatus, not heretofore disclosed in the prior art.

The program then proceeds to block 97, shown in FIG. 6B. In block 97 an estimate of the pressure (PR2E) within the reference cylinder for the adjusted total gas mass injection to a 90% fill state (DELMRITO90500) is computed using subroutine CHECKPRA, subroutine CHECKPRA calling sub-subroutine DELP2A in block 98. Thereafter, and as a part of subroutine CHECKPRA, in block 99 the estimated cylinder pressure (PR2E) is compared against the limit pressure (PRLIM) of the cylinder, and as shown in block 100, it is determined if the estimated cylinder pressure exceeds the cylinder limit pressure. If so, the program loops to block 101, whereby gas mass (DELMRITO90500) is adjusted, i.e., is reduced, the program then looping back to block 99 and repeating the process until the estimated cylinder pressure is not greater than the cylinder limit pressure, whereupon the program will proceed to block 102 of FIG. 6C, in which the computer will compute a revised total gas mass (DELMR2EIT090) to be injected into cylinder 8 for a 90% fill state, based on the adjustment to the gas mass in the reference cylinder in blocks 99 to 101.

Figure 6C:
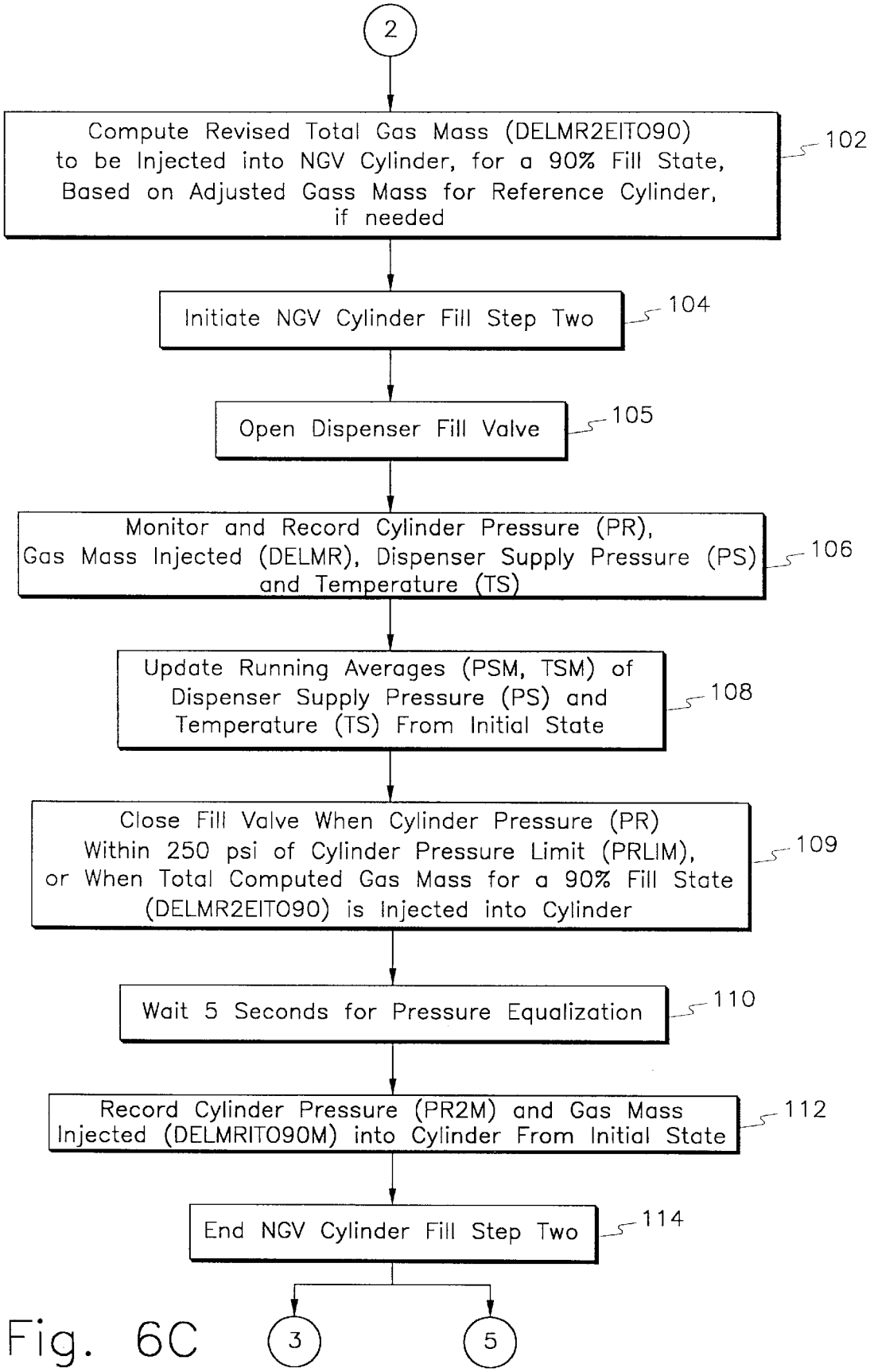
Figure 6D:
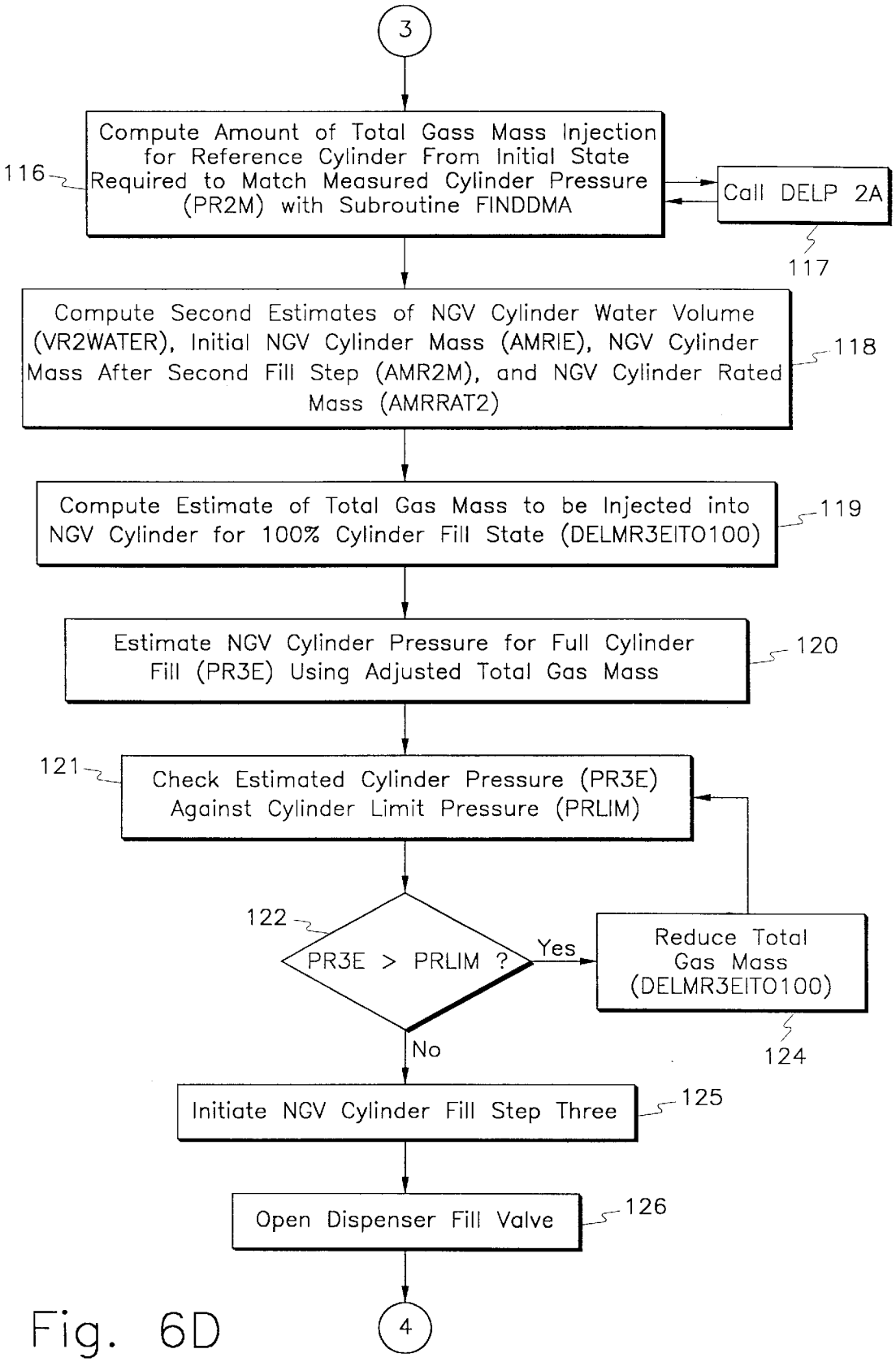

Still referring to FIG. 6C, cylinder fill step 2, shown in block 104, is next executed. Cylinder fill step 2 includes opening solenoid fill valve 21, as shown in block 105, once again monitoring and recording the cylinder pressure, gas mass injected, dispenser supply pressure, and temperature of the process, shown in block 106, and in block 108, updating the running averages (PSM,TSM) of the dispenser supply pressure and temperature supply pressure, respectively, from the initial state. The program then executes block 109, in which solenoid fill valve 21 is closed when the pressure within cylinder 8 is within 250 psi of the cylinder pressure limit, or when the total computed gas mass for a 90% fill state (DELMR2EIT090) has been injected into cylinder 8. Thereafter, and as shown in block 110, the system waits five seconds for pressure equalization within cylinder 8 and dispensing hose 25, whereupon a second pressure reading (PR2M) of the pressure within cylinder 8 is taken through pressure transducer 27, as well as a reading of the actual (second) gas mass (DELMRIT090M) injected into cylinder 8 from its initial state, i.e., prior to the start of the gas transfer process, as illustrated in block 112. The program then proceeds to block 114, ending cylinder fill step 2. Thereafter, and as shown in FIGS. 6D and 6E, the program can proceed toward a final fill step and thus complete the gas injection process after performing two estimates of the cylinder volume (See block 118), or can proceed to a second intermediate predetermined fill state and then to a final fill state, thus performing two more fill steps and a third cylinder volume calculation, shown in FIGS. 6D and 6E.

Turning first to the embodiment of the fill process illustrated in FIG. 6C, in which only one intermediate fill state occurs before the final fill, the program proceeds to a final fill process to complete the program and the injection of gas mass into cylinder 8. This is accomplished by computing the amount of the total gas mass injection, a fourth gas mass, for the reference cylinder (not illustrated) from its initial state required to match the measured cylinder pressure (PR2M) using subroutine FINDDMA, the subroutine calling sub-subroutine DELP2A in blocks 116 and 117 of FIG. 6C, respectively. Thereafter, and proceeding to block 118, the program computes a second estimate of the volume of cylinder 8 by computing a second estimate of the cylinder water volume, initial cylinder mass, cylinder mass after the second fill step, and the rated cylinder mass. The program then proceeds to block 119, in which it computes an estimate of the fifth gas mass (DELMR3EITO100) needed to be injected into cylinder 8 for a 100% cylinder fill state, i.e., a final cylinder fill.

This is done by executing block 120 in which a cylinder pressure (PR3E) is estimated for a full i.e., 100%, fill state for cylinder 8 using the adjusted total gas mass of block 119. The program then executes block 121 in which the estimated cylinder pressure (PR3E) is compared against the cylinder limit pressure (PRLIM), it being determined in block 122 if the estimated cylinder pressure exceeds the cylinder limit pressure. If so, the program loops to block 124 and reduces the total gas mass to be injected into cylinder 8, then looping back to block 121 until such time as block 122 determines that the estimated cylinder pressure is not greater than the cylinder limit pressure, whereupon the program executes block 125 and initiates cylinder fill step 3.

Figure 6E:
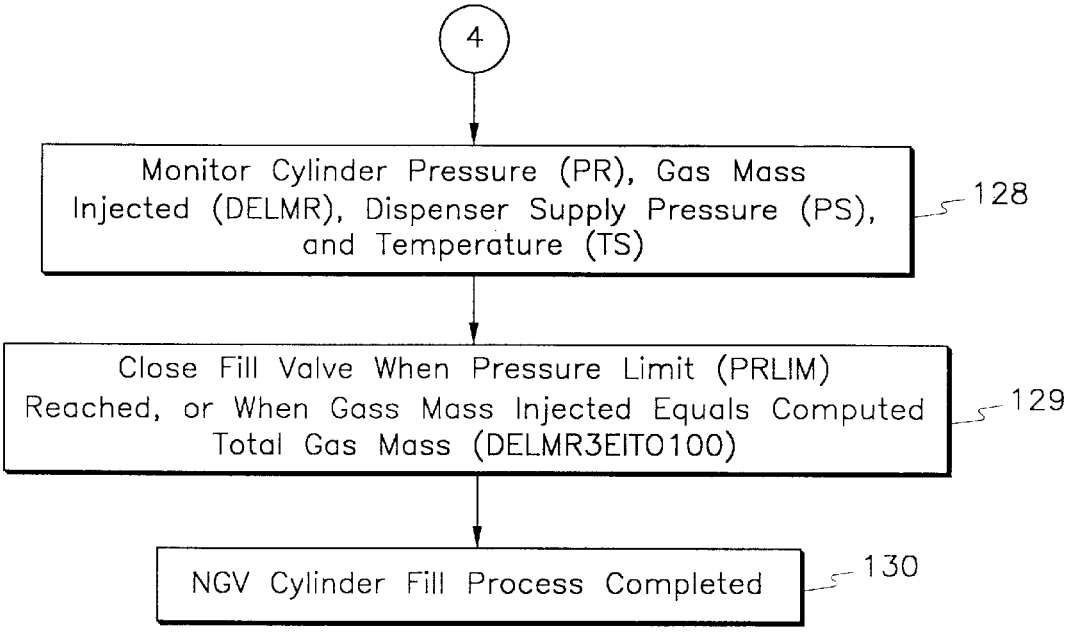

In cylinder fill step 3 solenoid fill valve 21 is opened in block 126, the cylinder pressure, gas mass injected, dispenser supply pressure, and temperature are once again monitored and recorded as shown in block 128 of FIG. 6E, and solenoid fill valve 21 is closed when the cylinder pressure limit is attained, or preferably, when the gas mass injected into cylinder 8 equals the computed total gas mass (DELMR3EITO100) shown in block 129. Thereafter, and as illustrated in block 130 of FIG. 6E, the cylinder fill process is completed.

The advantages of this cylinder fill process over others known in the art is that at least two estimates of the volume of cylinder 8 are taken, which enables a more accurate determination of the total gas mass that may be injected into cylinder 8 regardless of cylinder pressure readings taken of the process against the cylinder limit pressure so that a more accurate i.e., a complete, fill or charging process is attained so that the gas mass injected within cylinder 8 is maximized in a safe and efficient manner, thus maximizing the travel distance of motor vehicle 7 between gas injection or charging operations. Another unique aspect of the process described in FIGS. 6A through 6E is that the enthalpy of the compressed gas being injected into cylinder 8 is constantly being monitored, recorded, averaged, and used in the process to accurately determine the amount of gas mass that may be injected into cylinder 8 to once again maximize the cylinder gas mass fill.

Although the novel process illustrated in FIGS. 6A through 6E teaches a method for safely, accurately, and efficiently maximizing the injection of gas mass into a motor vehicle natural gas cylinder, this process will be even more accurate i.e., a more accurate full gas mass fill attained, if a series of intermediate fill steps is used in order to obtain several volume readings for cylinder 8, thus leading to greater precision and control in maximizing the gas mass injected into cylinder 8. Thus, a process using a second intermediate fill step followed by a final fill step is shown in the process of FIGS. 6F through 6I.

Figure 6F:
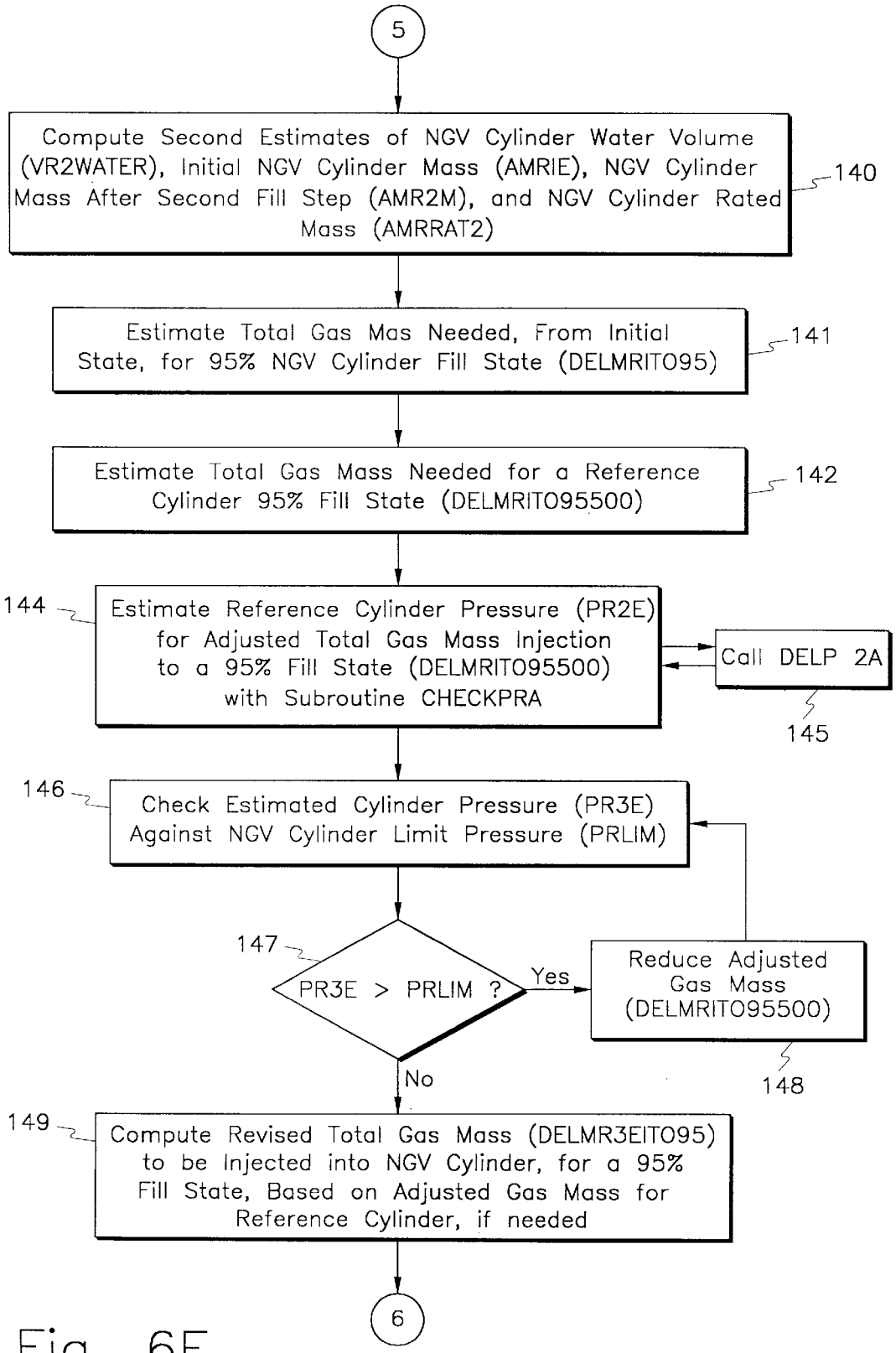
Figure 6G:
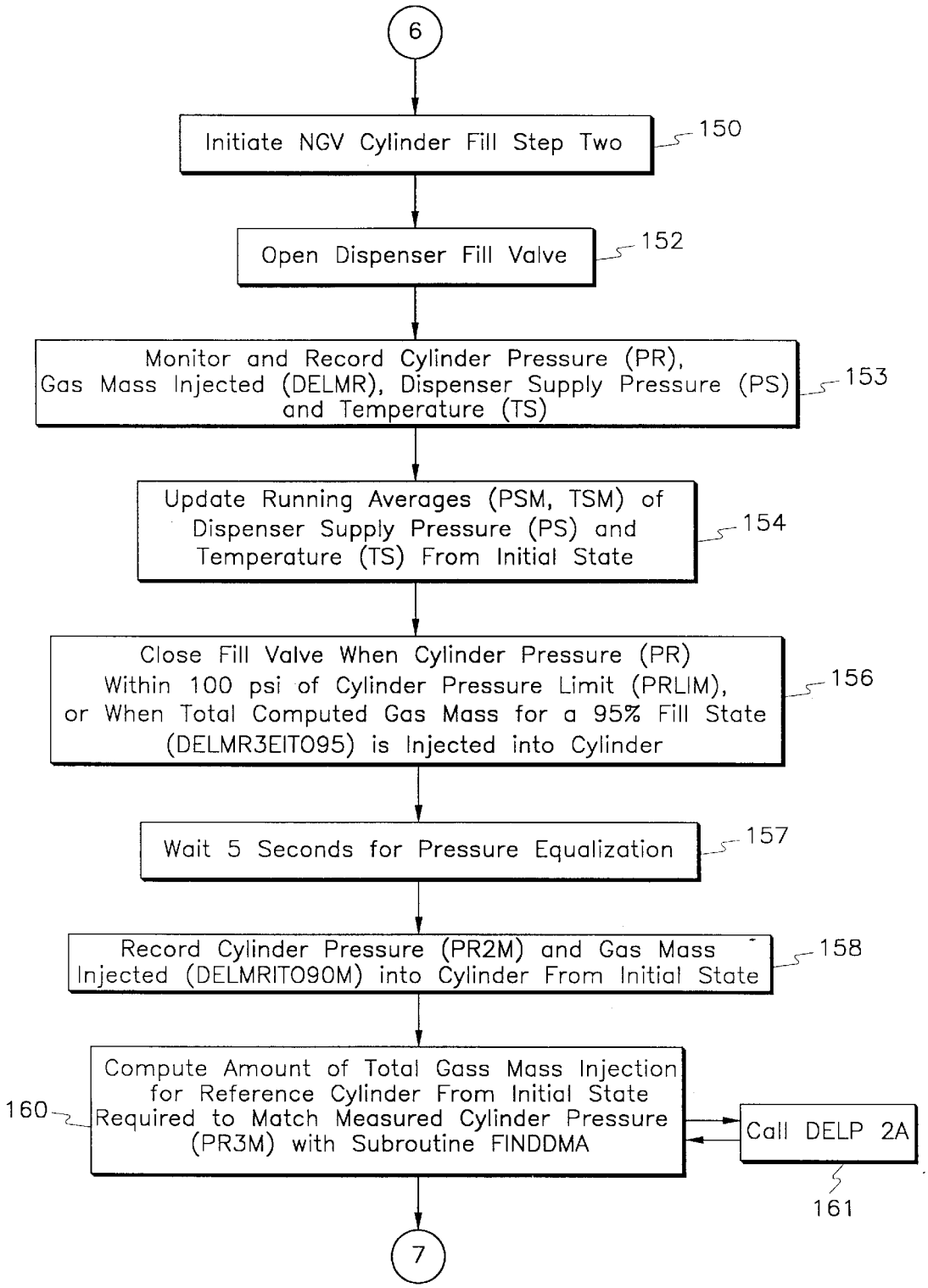

Turning first to FIG. 6F, block 140 is executed by dispenser control program 52 after completing block 114 of FIG. 6B. In block 140, dispenser control program 52 computes a second estimate of the cylinder water volume, initial cylinder mass, and cylinder mass after the second fill step, blocks 104 through 114, as well as the cylinder rated mass. The program then executes block 144, in which it determines a fourth mass (DELMRITO95) needed, from the initial state, for a 95% fill state for cylinder 8.

The program then executes block 142 in which it determines a fifth mass (DELMRITO95500) needed for the reference cylinder (not illustrated) to also attain a 95% cylinder fill state, i.e., a second intermediate or predetermined fill state, but not the final fill state, of cylinder 8. Once this is accomplished, the program executes subroutine CHECKPRA in block 144 in which it estimates a reference cylinder pressure (PR3E) for the fifth gas mass injection to a 95% fill state within cylinder 8, subroutine CHECKPRA calling sub-subroutine DELP2A in block 145. Subroutine CHECKPRA will then check the estimated cylinder pressure (PR3E) against the cylinder limit pressure (PRLIM) as shown in blocks 146 and 147. If the estimated cylinder pressure exceeds the cylinder limit pressure in block 147, the program loops to block 148, in which the fifth gas mass determined in block 142 is adjusted downward, the program then looping back to blocks 146 and 147 until such time as the estimated cylinder pressure does not exceed the cylinder limit pressure, whereupon subroutine CHECKPRA is completed and the program executes block 149, in which the fourth gas mass determined in block 141 is adjusted downward, based upon the adjustment of fifth gas mass (DELMRITO95500) in block 148, to attain a 95% fill state within cylinder 8.

The program then proceeds to a third cylinder fill step as shown in block 150 of FIG. 6C, this third cylinder fill step being a second intermediate fill step to a second predetermined fill state, not the final fill state. Cylinder fill step 3 includes blocks 152 in which solenoid fill valve 21 is opened, block 153 in which the program once again monitors and records the pressure and gas mass injected into cylinder 8 as well as the pressure and temperature of the supply gas, this information being used to once again measure the enthalpic reaction within cylinder 8 by updating the running averages of dispenser supply pressure (PSM) and temperature (TSM), respectively. Thereafter, and as shown in block 156, the program will close solenoid fill valve 21 by sending a control signal 73 to solenoid fill valve 21 (FIG. 4) when the pressure within cylinder 8 is within 100 psi of the cylinder pressure limit, or more preferably, when the total computed gas mass for 95% fill state has been injected into cylinder 8. Thereafter, and as with cylinder fill step 2, the system waits five seconds for pressure equalization as shown in block 157, and then proceeds to execute block 158, in which it records the pressure (PR3M) and gas mass injected (DELMRITO95M) into cylinder 8 from the initial state.

Once this is done, the program executes block 160, in which it calls subroutine FINDDMA to compute the amount of the total gas mass injection, the sixth gas mass, for the reference cylinder (not illustrated) from its initial state required to match the measured cylinder pressure (PR3M), and calls sub-subroutine DELP2A in block 161 to help accomplish this task.

Figure 6H:
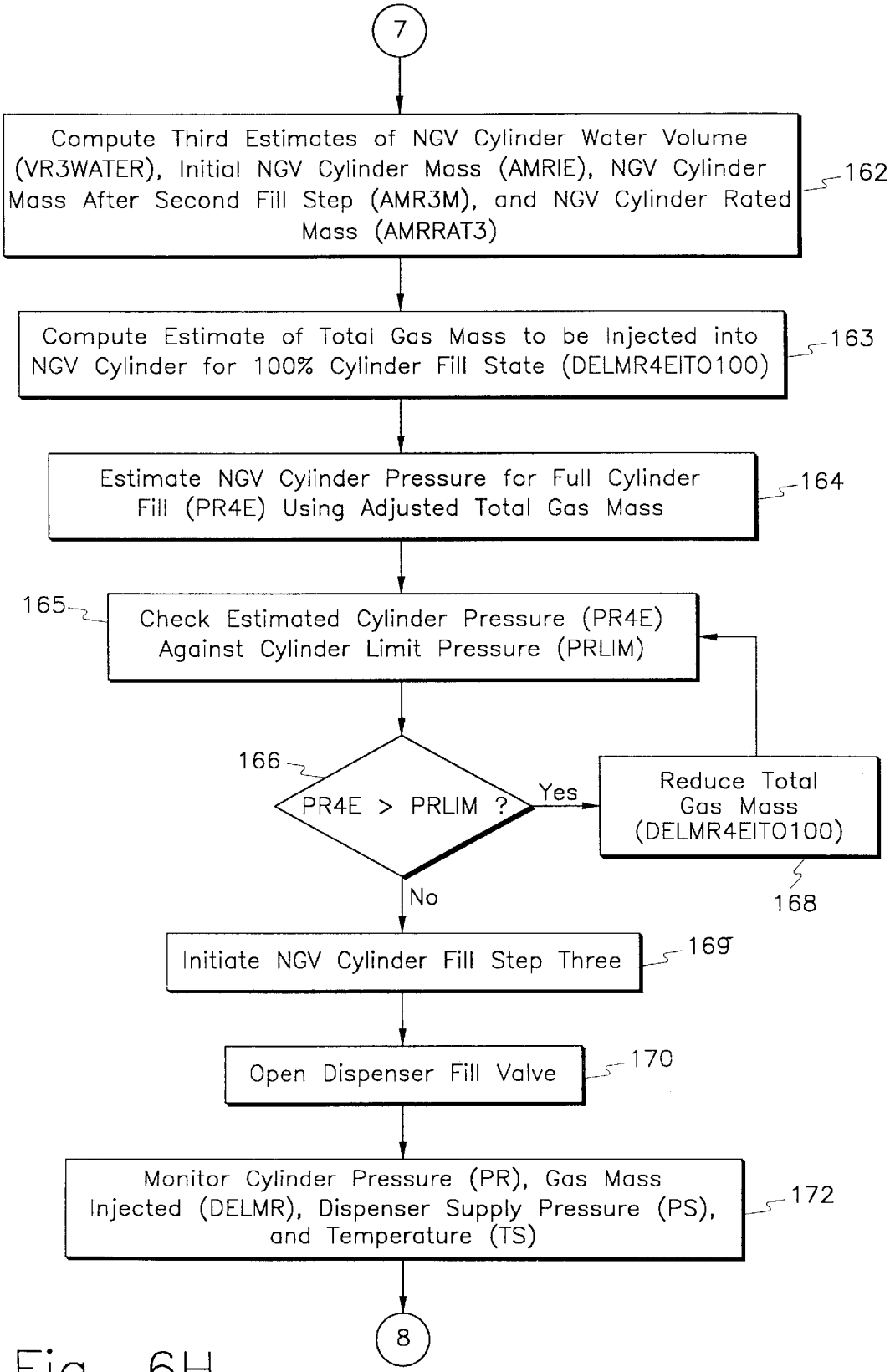

Thereafter, and as shown in block 162 of FIG. 6H, control program 52 computes a third estimate of the volume of cylinder 8 by calculating estimates of the cylinder water volume, initial cylinder mass, cylinder mass after the second fill step, and rated cylinder mass. The greater the number of intermediate fill steps, for example, an intermediate fill step of 45%, a second intermediate fill step of 65%, a third intermediate fill step of 85%, and a fourth intermediate fill step of 95%, the more accurate the determination of the cylinder volume will be and thus a more accurate determination of the total gas mass to be injected into the cylinder in order to maximize cylinder fill results. Thus, and although only four cylinder fill steps are shown in the process of FIGS. 6A through 6I, it is anticipated that more than four fill steps can be performed by the apparatus of FIGS. 4 and 5, and the method, i.e., computer program, of FIGS. 6A through 6I.

Returning to FIG. 6H, the program then executes block 163 in which it determines a seventh mass (DELMR4EITO100) required to be injected into cylinder 8 to attain a 100% cylinder fill state. The program then proceeds to block 164 in which it computes an estimate of the cylinder pressure (PR4E) needed for a full cylinder fill using the seventh gas mass of block 163. This is accomplished in blocks 165 through 168, in which the estimated cylinder pressure (PR4E) is compared against the cylinder limit pressure (PRLIM), and if the estimated cylinder pressure exceeds the cylinder limit pressure as shown in block 166, the program loops to block 168 in which the seventh gas mass determined in block 163 is reduced, the program then looping back to block 165 and block 166 until such time as the estimated cylinder pressure (PR4E) does not exceed the cylinder limit pressure (PRLIM), whereupon the program executes cylinder fill step four in block 169, the final cylinder fill step.

Figure 6I:
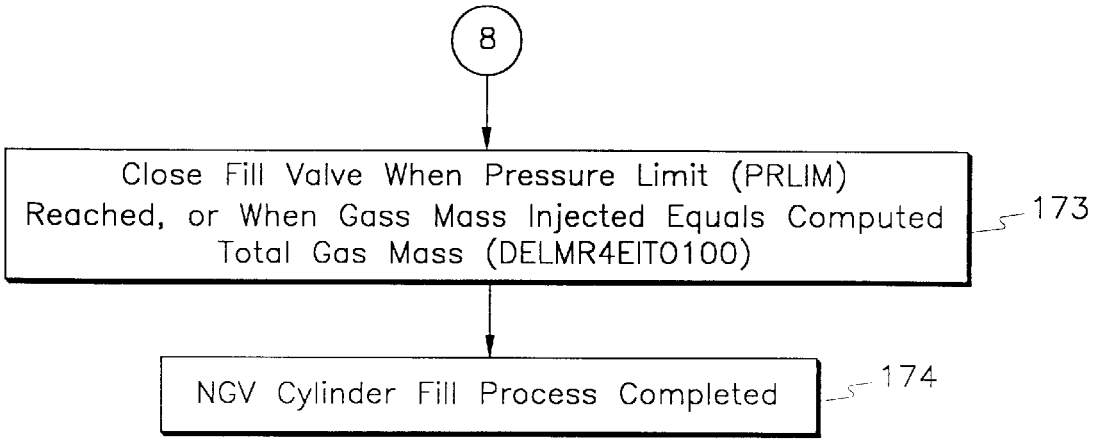

The final cylinder fill step includes opening solenoid fill valve 21 as shown in block 170, again monitoring the cylinder pressure and mass of gas injected into cylinder 8, as well as the pressure and temperature of the compressed gas supply in block 172, and finally, in block 173 of FIG. 6I, preferably closing solenoid fill valve 21 when the seventh gas mass has been injected into cylinder 8, or closing the solenoid fill valve when the cylinder pressure limit has been reached. The program then executes block 174 in which the cylinder fill process is completed, and control signal 73 (FIG. 4) closes solenoid fill valve 21. Connector 26 is then removed from motor vehicle 7, and motor vehicle 7 is free to pass on its way.

Contrasted with the known prior art, for example, U.S. Pat. No. 5,259,4242 to Miller et al, our method and apparatus provides an improved natural gas dispensing system which will accurately determine the volume of any natural gas vehicle cylinder 8, and will safely, efficiently, and quickly perform a fast fill charging process in which the maximum amount of compressed gas is injected into the cylinder to maximize the distance traveled by motor vehicle 7 between gas charging operations by constantly monitoring, recording, and averaging the enthalpic reaction resulting from the injection of compressed gas into cylinder 8, this enthalpic reaction not being taken into account by the prior art, and by computing several estimates of the volume of the cylinder in order to maximize the gas mass injected therein based on cylinder volume, as well as the pressure and temperature of the compressed gas, pressure within the cylinder before the start of the fill process, and the ambient temperature at the dispensing station.

While preferred embodiments of our invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function in the claimed elements are intended to include any structure, material, or acts for performing the functions in combination with other claimed elements, as specifically claimed herein.

APPENDIX

```
$NOTRUNCATE
   SUBROUTINE GASDEN(P,T,RHO)
C
C   THIS ROUTINE COMPUTES DENSITY OF MEAN U.S. GAS MIXTURE, FOR GIVEN
C   PRESSURE AND TEMERATURE (PRESSURE RANGE: 14.7-5000 PSIA)
C   UNITS:    P    PSIA
C            T    F
C           RHO    LBM/FT**3
C
   DIMENSION A0(5),A1(5),A2(5),A3(5),A4(5),A5(5),A6(5),A7(5),A8(5)
   DATA A0/-.2994295E+00,-.3343221E+01,-.2628989E+02,+.3092211E+02,
  &-.6128675E-02/
   DATA A1/-.3487948E-02,-.1842292E-01,-.5661105E-01,+.3983686E-02,
  &-.4368347E-03/
   DATA A2/+.8219936E-03,+.1352748E-01,+.8513020E-01,-.1486127E+00,
  &+.20888281E-04/
   DATA A3/+.3162543E+01,+.5992787E+01,+.1877627E+02,+.6835460E+01,
  &+.1742212E+01/
   DATA A4/-.1058533E+01,+.5557355E+00,+.2854977E+00,-.6623889E+00,
  &+.2014086E+00/
   DATA A5/+.8145651E+00,+.1126193E-01,-.5140347E-01,+.1701009E-01,
  &+.2001732E+00/
   DATA A6/+.9307038E-06,-.1638089E-05,+.6831632E-06,+.6680183E-06,
  &-.4553512E-06/
   DATA A7/-.6011406E-06,-.1360555E-04,-.6458707E-04,+.1462390E-03,
  &-.1761429E-07/
   DATA A8/+.2192528E-05,+.1921265E-04,+.4269540E-04,-.1280760E-04,
  &+.3721930E-06/
   IF (P.GT.5000) THEN
     WRITE (*,*) 'PRESSURE > 5000 PSIA IN SUBR GASDEN, P=',P
     WRITE (*,*) 'PROGRAM STOPS'
     STOP
   ENDIF
   IF (P.GE.100..AND.P.LT.300.) J=1
   IF (P.GE.300..AND.P.LT.1000.) J=2
   IF (P.GE.1000..AND.P.LT.2500.) J=3
   IF (P.GE.2500..AND.P.LE.5000.) J=4
   IF (P.LT.100.) J=5
   X1=P
   X2=T+459.6
   X3=X1/X2
   X4=X3*X3
   X5=X3*X4
   X6=X1**2
   X7=X2**2
   X8=X1*X2
   RHO=A0(J)+A1(J)*X1+A2(J)*X2+A3(J)*X3+A4(J)*X4
   RHO=RHO+  A5(J)*X5+A6(J)*X6+A7(J)*X7+A8(J)*X8
   RETURN
   END
```

```
$NOTRUNCATE
    SUBROUTINE FINDVR(PS,TS,PRI,PRF,DELMRMEAS,VR1E)
C
C    THIS ROUTINE FINDS A CYLINDER VOLUME, VR1E, AFTER A SMALL
C    INJECTION OF MASS
C
C    ADJUST THE MEASURED DELTA MASS TO THE REGRESSION RANGE OF
C    SUBROUTINE DELP1,I.E. 0 TO 7 LBM.
    ICODE=DELMRMEAS/7.+1
    DELMR=DELMRMEAS/ICODE
C
    VROLD=1000.
    CALL DELP1(VROLD,PS,TS,PRI,DELMR,DELPOLD)
    PROLD=PRI+DELPOLD
    VRNEW=1250.
10   CALL DELP1(VRNEW,PS,TS,PRI,DELMR,DELPNEW)
    PRNEW=PRI+DELPNEW
C
    ERROR=PRNEW-PRF
    IF (ABS(ERROR).GT.5.) THEN
     SLOPE=(PRNEW-PROLD)/(VRNEW-VROLD)
     VROLD=VRNEW
     PROLD=PRNEW
     DELVR=.5*ERROR/SLOPE
     IF (ABS(DELVR).GT.100..AND.DELVR.GE.0.) DELVR=100.
     IF (ABS(DELVR).GT.100..AND.DELVR.LE.0.) DELVR=-100.
C
C     WRITE (*,*) 'DELVR',DELVR
C
     VRNEW=VRNEW-DELVR
     IF (VRNEW.LT.250.) THEN
      VRNEW=250.
      WRITE (*,*) ' CYLINDER VOLUME ITEARATION FAILURE - PROGRAM STO
   &PS'
      STOP
     ENDIF
     GO TO 10
    ELSE
     VR1E=VRNEW*ICODE
     RETURN
    END IF
    RETURN
    END
```

```
$NOTRUNCATE
    SUBROUTINE DELP1(VR,PS,TS,PRI,DELMR,DELP)
C
C   THIS ROUTINE COMPUTES THE DELP EXPECTED FOR SMALL MASS INJECTIONS
C   INTO AN NGV CYLINDER
C
C   UNITS:
C       VR    SCF (RATED AT 3600 PSIA, 70 F)
C       PS    PSIA
C       TS    F
C       PRI   PSIA
C       DELMR  LBM
C       DELP   PSI
C
    A0= +.2276295E+03
    A1= -.8072531E+00
    A2= -.7289587E-02
    A3= +.1068918E+01
    A4= +.1086674E-01
    A5= +.2106255E+03
    A6= -.7376524E+01
    A7= +.5790426E-03
    A8= -.1122428E-06
    A9= +.2000129E-05
    A10=+.9500802E-08
    A11=+.1745315E-01
    A12=-.4552160E-04
    A13=-.9907739E-01
    A14=+.2313142E-05
    A15=+.8719245E+04
C
    X1=VR
    X2=PS
    X3=TS
    X4=PRI
    X5=DELMR
    X6=X5*X5
    X7=X1*X1
    X8=X1*X7
    X9=X4*X4
    X10=X4*X9
    X11=X4*X5
    X12=X4*X1
    X13=X5*X1
    X14=X13*X13
    X15=X4*X1/(TS+459.6)
    X15=X5/X15
    X15=X15*X15
C
    DELP=A0+A1*X1+A2*X2+A3*X3+A4*X4+A5*X5+A6*X6+A7*X7+A8*X8+A9*X9
    DELP=DELP+A10*X10+A11*X11+A12*X12+A13*X13+A14*X14+A15*X15
    RETURN
    END
```

```
$NOTRUNCATE
    SUBROUTINE CHECKPRA(PS,TS,PRI,TRI,PRLIM,DELMRIN,PRPRED,DELMROUT)
C
C    THIS ROUTINE CHECKS, FOR DELMRIN, WHETHER THE PREDICTED CYLINDER
C    PRESSURE, IN A 500 SCF CYLINDER, WILL EXCEED PRLIM.  IF IT DOES,
C    DELMR IS ADJUSTED DOWNWARD IN .025 LBM INCREMENTS, TO PASS THAT TEST.
C    THE OUTPUT DELMR WHICH PASSES THE TEST IS ARGUMENT DELMROUT
C
    DELMR=DELMRIN
10   CALL DELP2A(PS,TS,PRI,TRI,DELMR,DELP)
    PRPRED=PRI+DELP
    IF (PRPRED.GT.PRLIM) THEN
     DELMR=DELMR-.025
     GO TO 10
    ELSE
     DELMROUT=DELMR
     RETURN
    END IF
    RETURN
    END
```

```
$NOTRUNCATE
   SUBROUTINE FINDDMA(PS,TS,PRI,TRI,PRFM,DELMR)
C
C   THIS ROUTINE FINDS THE DELMR, FOR A 500 SCF CYLINDER,
C   SUCH THAT THE PRF MATCHES THE INPUT MEASURED PRFM
C
   DELMOLD=20.
   CALL DELP2A(PS,TS,PRI,TRI,DELMOLD,DELPOLD)
   PROLD=PRI+DELPOLD
   DELMNEW=21.
10  CALL DELP2A(PS,TS,PRI,TRI,DELMNEW,DELPNEW)
   PRNEW=PRI+DELPNEW
C    WRITE (*,*) 'PRNEW,DELMNEW',PRNEW,DELMNEW
   ERROR=PRNEW-PRFM
   IF(ABS(ERROR).GT.5.) THEN
    SLOPE=(PRNEW-PROLD)/(DELMNEW-DELMOLD)
    DELMOLD=DELMNEW
    PROLD=PRNEW
    DELM=.5*ERROR/SLOPE
    IF (ABS(DELM).GT.1..AND.DELM.GT.0.) DELM=.1
    IF (ABS(DELM).GT.1..AND.DELM.LT.0.) DELM=-.1
    DELMNEW=DELMNEW-DELM
    GO TO 10
   ELSE
    DELMR=DELMNEW
    RETURN
   END IF
   RETURN
   END
```

```
$NOTRUNCATE
   SUBROUTINE DELP2A(PS,TS,PRI,TRI,DELMR,DELP)
C
C   THIS ROUTINE COMPUTES THE DELP EXPECTED FOR MASS INJECTIONS
C   INTO A 500 SCF NGV CYLINDER (BASED ON 6/5/95 AND 11/21/95 REGRESSIONS)
C
C   UNITS:
C       PS    PSIA
C       TS    F
C       PRI   PSIA
C       TRI   F
C       DELMR  LBM
C       DELP   PSI
C
   IF (TRI.GE.50) THEN
   A0= -.1181484E+03
   A1= +.4809314E-02
   A2= +.4307871E+00
   A3= +.7606027E+00
   A4= -.2126258E+00
   A5= +.8949869E+02
   A6= -.7304727E+01
   A7= +.6741005E+00
   A8= -.9749865E-02
   A9= -.1566937E-02
   A10=+.9088554E-06
   A11=-.1591090E-09
   A12=-.1019546E-04
   A13=+.5050260E+04
   A14=-.1933335E+05
   A15=+.6953606E+00
   A16=+.6091729E-01
   A17=+.1219411E-05
   ELSE
   A0= -.6295708E+02
   A1= +.1137363E-02
   A2= -.2910651E+00
   A3= -.2989736E+00
   A4= -.2428457E-01
   A5= +.1906508E+03
   A6= -.1806205E+02
   A7= +.1202792E+01
   A8= -.2088573E-01
   A9= +.1237217E-03
   A10=+.5009747E-07
   A11=-.1639634E-10
   A12=-.8676208E-04
   A13=-.5754610E+03
   A14=+.3579647E+04
   A15=+.8329901E+00
   A16=+.8973119E-02
   A17=+.3187786E-05
   END IF
```

```
      X1=PS
      X2=TS
      X3=PRI
      X4=TRI
      X5=DELMR
      X6=X5*X5
      X7=X5*X5*X5
      X8=X5*X5*X5*X5
      X9=X3*X3
      X10=X3*X3*X3
      X11=X3*X3*X3*X3
      X12=(X2-X4)**3
      X13=X5/X3
      X14=X13*X13
      X15=X5*X2
      X16=X5*X3
      X17=X16**2
C
      DELP=A0+A1*X1+A2*X2+A3*X3+A4*X4+A5*X5+A6*X6+A7*X7+A8*X8+A9*X9
      DELP=DELP+A10*X10+A11*X11+A12*X12+A13*X13+A14*X14+A15*X15
      DELP=DELP+A16*X16+A17*X17
      RETURN
      END
```

We claim:

1. A computer-readable medium having a computer program for operating an automated compressed gas dispensing station used for filling compressed gas containers, the gas container having an initial pressurized state and a limit pressure, said computer program comprising:

a) a mechanism for injecting a first mass of compressed gas into the gas container;

b) a mechanism for estimating the volume of the gas container a first time in response thereto;

c) a mechanism for estimating a second mass of compressed gas required to fill the gas container to a first predetermined fill state;

d) a mechanism for estimating a third mass of compressed gas required to fill a reference gas cylinder to said first predetermined fill state in response thereto;

e) a mechanism for injecting said second mass of compressed gas into the gas container;

f) a mechanism for processing the amount of gas mass injected into the gas container from the initial state, and for processing the pressure of the compressed gas within the gas container resulting from the injection of said second mass of compressed gas into the gas container; and g) a mechanism for estimating the volume of the gas container a second time in response thereto.

2. The computer-readable medium of claim 1, further comprising:

a) a mechanism for computing a fourth mass of compressed gas that will result in a compressed gas pressure within said reference cylinder, from an initial reference cylinder state, equal to the measured pressure of the compressed gas within the gas container after said second mass of compressed gas has been injected therein;

b) a mechanism for computing a fifth mass of compressed gas to be injected into the gas container for attaining a second predetermined fill state in response thereto; and c) a mechanism for injecting said fifth mass of compressed gas into the gas container.

3. The computer-readable medium of claim 2, further comprising:

a) a mechanism for estimating the compressed gas pressure within the gas container resulting from the injection of said fifth mass of compressed gas therein;

b) a mechanism for comparing said estimate of the compressed gas pressure within the gas container to the limit pressure of the gas container;

c) a mechanism for reducing said fifth mass of compressed gas mass to be injected into the gas container if said estimate of the compressed gas pressure within the gas container is greater than the limit pressure of the gas container; and d) a mechanism for polling mechanisms a) through c) until said estimate of the compressed gas pressure within the gas container is no longer greater than the limit pressure of the gas container.

4. The computer-readable medium of claim 1, further comprising:

a) a mechanism for calculating an estimate of the pressure that will result in said reference cylinder from the injection of said third mass of compressed gas therein to attain said first predetermined fill state;

b) a mechanism for comparing said estimate of the pressure of the compressed gas within said reference cylinder to the limit pressure of the gas container;

c) a mechanism for reducing said third mass of compressed gas to be injected into said reference cylinder if said estimate of the pressure of the compressed gas within said reference cylinder is greater than the limit pressure of the gas container;

d) a mechanism for polling mechanisms a) through c) until said estimate of the compressed gas pressure within said reference cylinder is no longer greater than the limit pressure of the gas container; and e) a mechanism for reducing said second mass of compressed gas to be injected into the gas container in response to reducing said third mass of compressed gas within said reference cylinder.

5. The computer-readable medium of claim 1, further comprising:

a central processing unit;

an input device configured to receive data to be relayed to said central processing unit;

an output device for relaying a control signal emitted by said central processing unit; and a data bus for interconnecting said central processing unit, said computer-readable medium, said input device, and said output device.

6. The computer-readable medium of claim 5, wherein said medium is situated within a portable storage container.

* * * * *

UNITED STATES PATENT AND TRADEMARK OFFICE

CERTIFICATE OF CORRECTION

PATENT NO. : 5,771,947
DATED : June 30, 1998
INVENTOR(S) : Kountz, *et al.*

It is certified that error appears in the above-identified patent and that said Letters Patent is hereby corrected as shown below:

On the title page, insert the following:

References Cited

U.S. PATENT DOCUMENTS

| | | | |
|---|---|---|---|
| 4,010,623 | 03-08-77 | Kaschak | 62/55 |
| 4,419,898 | 12-13-83 | Zanker, et al. | 73/861.02 |
| 4,527,600 | 07-09-85 | Fisher, et al. | 141/4 |
| 4,865,088 | 09-12-89 | Stearns | 141/5 |
| 4,883,099 | 11-28-89 | Vanommeren | 141/1 |
| 4,898,217 | 02-06-90 | Corbo, et al. | 141/83 |
| 4,966,206 | 10-30-90 | Baumann, et al. | 141/98 |
| 4,987,932 | 01-29-91 | Pierson | 141/001 |
| 5,029,622 | 07-09-91 | Mutter | 141/4 |
| 5,211,021 | 05-18-93 | Pierson | 62/50.2 |
| 5,259,424 | 11-09-93 | Miller, et al. | 141/4 |
| 5,351,726 | 10-04-94 | Diggins | 141/4 |
| 5,365,981 | 11-22-94 | Peschka, et al. | 141/7 |
| 5,373,702 | 12-20-94 | Kalet, et al. | 62/50.2 |
| 5,406,988 | 04-18-95 | Hopkins | 141/2 |

UNITED STATES PATENT AND TRADEMARK OFFICE

CERTIFICATE OF CORRECTION

PATENT NO. : 5,771,947
DATED : June 30, 1998
INVENTOR(S) : Kountz, *et al.*

It is certified that error appears in the above-identified patent and that said Letters Patent is hereby corrected as shown below:

| | | | |
|---|---|---|---|
| **5,409,046** | **04-25-95** | **Swenson, et al.** | **141/11** |
| **5,411,374** | **05-02-95** | **Gram** | **417/53** |
| **5,431,203** | **07-11-95** | **Schultz, et al.** | **141/197** |
| **5,465,583** | **11-14-95** | **Goode** | **62/50.2** |
| **5,628,349** | **05-13-97** | **Diggins, et al.** | **141/3** |
| **5,835,176** | **01-31-95** | **Price** | **141/1** |

In column 2, line 15, delete "represents" and replace with "represent ".

In column 3, line 8, delete "takes" and replace with "take".

In column 5, line 16, add "the" between "of" and "invention".

In column 5, line 36, delete the second appearance of "is".

In column 6, line 17, add "the" between "by" and "dispensing".

In column 6, line 20, delete "of" and replace with "to".

In column 6, line 21, delete "through" and replace with "throughout".

UNITED STATES PATENT AND TRADEMARK OFFICE

CERTIFICATE OF CORRECTION

PATENT NO. : 5,771,947
DATED : June 30, 1998
INVENTOR(S) : Kountz, *et al.*

It is certified that error appears in the above-identified patent and that said Letters Patent is hereby corrected as shown below:

In column 14, line 10, delete "5,259,4242" and replace with "5,259, 424".

Signed and Sealed this

Twenty-second Day of December, 1998

*Attest:*

Bruce Lehman

BRUCE LEHMAN

*Attesting Officer*

*Commissioner of Patents and Trademarks*